US007089901B2

(12) United States Patent
Kino et al.

(10) Patent No.: US 7,089,901 B2
(45) Date of Patent: Aug. 15, 2006

(54) RESONATOR

(75) Inventors: Hitoshi Kino, Aichi (JP); Yutaka Ogasawara, Aichi (JP)

(73) Assignee: Toyoda Gosei Co., Ltd., Aichi-ken (JP)

( * ) Notice: Subject to any disclaimer, the term of this patent is extended or adjusted under 35 U.S.C. 154(b) by 0 days.

(21) Appl. No.: 11/091,571

(22) Filed: Mar. 29, 2005

(65) Prior Publication Data

US 2005/0217626 A1 Oct. 6, 2005

(30) Foreign Application Priority Data

Mar. 30, 2004 (JP) ..... P2004-100271
Mar. 30, 2004 (JP) ..... P2004-100299

(51) Int. Cl.
*F02M 35/10* (2006.01)

(52) U.S. Cl. ..... 123/184.57; 181/229

(58) Field of Classification Search ..... 123/184.57; 181/204, 229

See application file for complete search history.

(56) References Cited

U.S. PATENT DOCUMENTS 5,377,629 A * 1/1995 Brackett et al. ..... 181/229
6,792,907 B1 * 9/2004 Kostun et al. ..... 123/184.57
2003/0230273 A1 * 12/2003 Koelmel et al. ..... 123/184.57

FOREIGN PATENT DOCUMENTS

| | | |
|---|---|---|
| JP | A-5-18224 | 1/1993 |
| JP | A-2001-50127 | 2/2001 |
| JP | A-2002-21659 | 1/2002 |

* cited by examiner

*Primary Examiner*—Noah P. Kamen
(74) *Attorney, Agent, or Firm*—Posz Law Group, PLC

(57) ABSTRACT

A resonator comprises a housing arranged in an intake member for defining an opening to communicate with an intake passage and a volume portion to communicate with the opening portion, a movable partition which can change the volume of the volume portion, and a movable cover associated with the movable partition for changing the opening area of the opening portion.

21 Claims, 24 Drawing Sheets

RESONATOR

This application is based on Japanese Patent Application Nos. 2004-100271 and 2004-100299, which are incorporated herein by reference.

BACKGROUND OF THE INVENTION

1. Field of the Invention

The present invention relates to a resonator for suppressing intake noises.

2. Description of the Related Art

A Helmholtz type resonator is provided with a cylindrical member and a housing. The cylindrical member is branched and connected at its one end to an intake duct. This intake duct is defined into an intake passage. This intake passage is opened at its cylindrical member connecting portion to form an opening. The housing is connected to the other end of the cylindrical member. The inside of the housing is defined into a volume portion.

Here, the resonance frequency f of the resonator can be obtained for a sound velocity C, an opening area S of the opening, a length L of the cylindrical member and a volume V of the volume portion from the following Formula:

$$f = \frac{C}{2\pi}\sqrt{\frac{S}{V \cdot L}} \qquad \text{[Formula 1]}$$

Here, the frequency of the intake noises varies in proportion to the engine speed. In JP-A-2001-50127, therefore, there is introduced a Helmholtz type resonator, which can vary the opening area S of an opening in accordance with the engine speed. From the aforementioned Formula, the resonance frequency f of the resonator can be varied if the opening area S is varied. In the case of the resonator described in that patent publication, at every engine speeds, the sound-pressure level near the frequency F is lowered by equalizing the resonance frequency f to a desired frequency F of the intake noises.

The intake noises are composed of a plurality of components corresponding to the explosions of the combustion chambers of the engine. FIG. 17A plots the primary explosion components of the intake noises of a four-cylinder engine, and FIG. 17B plots the secondary explosion components of the intake noises of the four-cylinder engine. In case the engine speed is 5,000 rpm, in the primary explosion components of FIG. 17A, the frequency to be reduced in the sound-pressure level is 250 Hz. In the case of the same engine speed, in the secondary explosion components of FIG. 17B, the frequency to be reduced in the sound-pressure level is 500 Hz.

In the case of the resonator described in the publication, however, at an arbitrary single engine speed, only one frequency range can reduce the sound-pressure level. When the intake noises at the engine speed of 5,000 rpm are to be reduced by using the resonator of that publication, therefore, it is possible to reduce the sound-pressure level in the neighborhood of the frequency of 250 Hz (of the primary explosion components) but not the sound-pressure level in the neighborhood of the frequency of 500 Hz (of the secondary explosion components). Alternatively, the sound-pressure level in the neighborhood of the frequency of 500 Hz (of the secondary explosion components) can be reduced but the sound-pressure level in the neighborhood of the frequency of 250 Hz (of the primary explosion components) cannot. In case the sound-pressure levels of the two frequency ranges are to be reduced, therefore, it is necessary to arrange a plurality of resonators in the intake duct.

In order to solve this problem, JP-A-5-18224 introduced the resonator which can reduce the sound-pressure levels in two frequency ranges at an arbitrary single engine speed. The inside of the housing of the resonator disclosed is partitioned by a movable partition into a first volume portion and a second volume portion. The first volume portion is connected to the intake duct through a first cylindrical member. The second volume portion is connected to the intake duct through another second cylindrical member. The volume V1 of the first volume portion and the volume V2 of the second volume portion can be changed by movable the movable partition. According to the resonator disclosed, therefore, it is possible to separately set a resonance frequency f1 relating to the first volume portion and a resonance frequency f2 relating to the second volume portion.

However, the volume V1 of the first volume portion and the volume V2 of the second volume portion cannot be varied independently of each other. If the total volume is designated by Vt, a relation of Vt=V1+V2 holds. As a result, the volume V2 necessarily becomes smaller if the volume V1 is increased. If the volume V2 is increased, on the contrary, the volume V1 necessarily becomes smaller.

If this event is substituted for the Formula 1, the volume V1 has to be reduced in case the resonance frequency f1 relating to the first volume portion is shifted to a higher frequency side. If the volume V1 is reduced, however, the volume V2 inevitably increases. Therefore, the resonance frequency f2 relating to the second volume portion inevitably shifts to the lower frequency side. In short, the resonance frequency f1 and the resonance frequency f2 shift in the opposite directions.

On the contrary, the volume V1 has to be enlarged in case the resonance frequency f1 relating to the first volume portion is shifted to a lower frequency side. If the volume V1 is enlarged, however, the volume V2 inevitably decreases. Therefore, the resonance frequency f2 relating to the second volume portion inevitably shifts to the higher frequency side. In short, the resonance frequency f1 and the resonance frequency f2 shift in the opposite directions.

Thus, according to the resonator described in the same publication, the two resonance frequencies f1 and f2 shift in the opposite directions. However, the frequency of the intake noises vary in proportion to the engine speed, as described hereinbefore. In case the engine speed is 2,000 rpm in FIGS. 17A and 17B, for example, the frequency of the primary explosion components of FIG. 17A is 100 Hz, and the frequency of the secondary explosion components of FIG. 17B is 200 Hz. In case the engine speed is 4,000 rpm, on the other hand, the frequency of the primary explosion components of FIG. 17A is 200 Hz, and the frequency of the secondary explosion components of FIG. 17B is 400 Hz. According to the resonator of the same publication, therefore, it is difficult at an arbitrary engine speed to make the two resonance frequencies f1 and f2 correspond to frequencies F1 and F2, the sound-pressure levels of which are to be lowered.

On the other hand, JP-A-2002-21659 introduces a dual intake system for retaining two intake passages by two intake ducts. According to this intake system, it is possible to feed the combustion chambers of the engine with much intake air.

If the dual intake system is adopted, however, the more parts such as an intake duct, an air cleaner or an air cleaner hose are required for the intake passages. Therefore, the assembling works become complicated. The more parts number makes their space the larger. As a result, the limited space in the engine room is narrowed by the dual intake system. Moreover, the large parts number complicates the structure.

As the engine speed grows the higher, on the other hand, the combustion chambers of the engine demand the more intake air. In case the engine speed is low, therefore, the intake passage of only one line can feed the combustion chambers with the intake air of a desired amount. Of the two intake passages of the dual intake system, therefore, one intake passage is excessive, only in case the engine speed is low.

SUMMARY OF THE INVENTION

The resonator of the invention has been completed in view of the problems thus far described.

Therefore, an object of the invention is to provide a resonator which can make a plurality of frequencies to be reduced in the sound-pressure level in suction noises and a plurality of own resonance frequencies correspond to each other.

Another object of the invention is to provide a resonator which can increase/decrease the number of passages for intake air in response to an engine speed.

According to a first aspect of the invention, there is provided a resonator comprising a housing arranged in an intake member for defining an opening to communicate with an intake passage and a volume portion to communicate with the opening portion, a movable partition which can change the volume of the volume portion, and a movable cover associated with the movable partition for changing the opening area of the opening portion.

According to a second aspect of the invention, there is provided a resonator comprising a housing arranged in an intake member defining an intake passage, for defining a first opening and a second opening to communicate with the intake passage, a first volume portion to communicate with the first opening, and a second volume portion to communicate with the second opening, a movable partition made movable for partitioning the first volume portion and the second volume portion to change the volume of the first volume portion and the volume of the second volume portion, and a movable cover associated with the movable partition for changing the opening area of the second opening.

According to the resonator of the invention, it is possible to change not only the volume of the first volume portion and the volume of the second volume portion but also the opening area of the second opening. It is, therefore, possible to suppress the shifts of two resonant frequencies in the opposite directions, as described hereinbefore. According to the resonator of the invention, therefore, the two frequencies to be reduced in the sound-pressure level in the intake noises and the two resonance frequencies are easily made to correspond to each other.

Moreover, it is preferable that the resonator further comprises a cylindrical member for defining a communicating portion to provide the communication between the first opening and the first volume portion. According to this structure, a Helmholtz type resonator is formed of the first opening and the first volume portion defining portion in the housing and the cylindrical member for defining the communication portion. The Helmholtz type resonator has a large reducing width of the sound-pressure level. According to this structure, therefore, it is possible to reduce the sound-pressure level of a desired frequency drastically.

It is preferable that the movable partition and the movable cover move, for the volume V1 of the first volume portion, the volume V2 of the second volume portion and the opening area S2 of the second opening, such that V1 decreases and such that S2/V2 increases in case the engine speed rises.

The resonance frequency f1 relating to the first volume portion 22 can be obtained for a sound velocity C, an opening area S1 of the first opening, a distance L1 from the intake passage to the first volume portion, and a volume V1 of the first volume portion from the following Formula:

$$f1 = \frac{C}{2\pi}\sqrt{\frac{S1}{V1 \cdot L1}} \quad \text{[Formula 2]}$$

As the engine speed rises, the frequency F1 of intake noises rises. In the case of this structure, on the contrary, as the engine speed rises, the volume V1 of the first volume portion 22 lowers. As a result, the resonance frequency f1 rises. Therefore, the shifting direction of the frequency F1 of the intake noises and the shifting direction of the resonance frequency f1 align with each other.

Likewise, a resonance frequency f2 relating to the second volume portion can be obtained for the sound velocity C, an opening area S2 of the second opening, a distance L2 from the intake passage to the second volume portion and a volume V2 of the second volume portion from the following Formula;

$$f2 = \frac{C}{2\pi}\sqrt{\frac{S2}{V2 \cdot L2}} \quad \text{[Formula 3]}$$

If the sum of the volume of the first volume portion and the volume of the second volume portion is designated by Vt, a relation of Vt=V1+V2 holds.

As the engine speed rises, the frequency F2 of the intake noises rises. In the case of this structure, on the contrary, as the engine speed rises, the volume V1 of the first volume portion lowers so that the volume V2 (=Vt−V1) of the second volume portion 23 inevitably rises. Here, the opening area S2 of the second opening increases together with the volume V2. At the same time, the volume V2 and the opening area S2 are so set that the ratio of S2/V2 rises. As a result, the resonance frequency f2 rises. This aligns the shifting direction of the frequency F2 of the intake noises and the shifting direction of the resonance frequency f2 with each other.

Thus, according to this structure, the two resonance frequencies f1 and f2 can be shifted in the same direction as the engine speed changes. specifically, in case the engine speed is high (i.e., in case the frequencies F1 and F2 of the intake noises are high), the resonance frequencies f1 and f2 can be set to a high-frequency range. In case the engine speed is low (i.e., in case the frequencies F1 and F2 of the intake noises are low), the resonance frequencies f1 and f2 can be set to a low-frequency range. In other words, according to this structure, the two frequencies to be reduced in the sound-pressure level in the intake noises and the two resonance frequencies are easily made to correspond to each other.

It is preferable that the movable partition and the movable cover are moved by the vacuum of the intake air to flow through the intake passage. According to this structure, it is possible to dispense with the driving parts such as the motor, the speed sensor and the controller for moving the movable partition and the movable cover. As a result, it is possible to reduce the cost for manufacturing the resonator. Moreover, the structure of the resonator is simplified.

It is preferable that resonator further comprises a differential pressure throttling portion disposed in the intake member at a portion, where the first opening is opened, for throttling the sectional area of the intake passage to establish a differential pressure between the first volume portion and the second volume portion thereby to drive the movable partition and the movable cover.

According to this structure, the intake air to flow through the differential pressure throttling portion takes a higher flow velocity. As a result, the vicinity of the first opening is evacuated. The first opening and the first volume portion are made to communicate with each other. As a result, the first volume portion is also evacuated. When the first volume portion is evacuated, the internal pressure of the first volume portion becomes lower than that of the second volume portion therefore, the movable partition and the movable cover move toward the first volume portion. According to this structure, the movable partition and the movable cover can be moved by the relatively simple method of providing the differential pressure throttling portion.

It is preferable that the second opening has a slit shape. In this structure, the cavity type resonator is formed by the slit-shaped second opening and the second volume portion defining portion in the housing. The cavity type resonator has a wide frequency range for reducing the sound-pressure level. According to this structure, therefore, it is possible to reduce the sound-pressure level of the wide frequency range containing the desired frequency. Moreover, the variation in the frequency can be easily adjusted according to the direction and size of the slit.

It is preferable that the second opening is formed of a pore group having a multiplicity of pores. Specifically, this structure forms the cavity type resonator with the pore group and the second volume portion defining portion in the housing. According to this structure, therefore, it is possible to reduce the sound-pressure level over the wide frequency range containing the desired frequency.

It is preferable that the movable partition includes a communication aperture for providing the communication between the first volume portion and the second volume portion, and that the resonator further comprises an air-permeable member for closing the communication aperture. FIG. 18 illustrates a schematic diagram for reducing a sound-pressure level. When the sound-pressure level of an arbitrary frequency is reduced, as shown, anti-resonant portions (as hatched) having high sound-pressure levels may be manifested on the low-frequency side and the high-frequency side of that frequency. In view of this point, the air-permeable member is arranged in the communication aperture of the movable partition of this structure. The manifest of the anti-resonant portion can be suppressed by arranging the air-permeable member.

It is preferable that the housing further defines a third opening for communicating with the intake passage and the first volume portion, that the movable cover closes the third opening and changes the opening area of the second opening, in case the engine speed is from low to intermediate, and that the movable cover closes the second opening, and a bypass intake passage for providing the communication among the first opening, the first volume portion and the third opening is opened, in case the engine speed is high.

According to this structure, in case the engine speed is from low to intermediate, the sound-pressure level of the desired frequency from the low-frequency range to the intermediate-frequency range can be lowered by the pair of the first opening and the first volume portion and the pair of the second opening and the second volume portion. In case the engine speed is high, on the other hand, the first volume portion acts as the expansion chamber type resonator. This can lower the sound-pressure level in the high-frequency range.

At the same time, the bypass intake passage is opened as the engine speed becomes high. This can retain the dual intake-passages. As a result, the parts number of the intake system can be made smaller than that of the case, in which the two intake systems (composed of the intake duct, the resonator, the air cleaner, the air cleaner hose and the throttle body, for example) are arranged separately and independently in the engine room. Moreover, it is possible to reduce the manufacture cost. Still moreover, the space ratio of the engine room to be occupied by the intake system is reduced.

It is preferable that the resonator further comprises a bypass throttling portion arranged in the intake member between the portion, in which the first opening is opened, and the portion, in which the third opening is opened, for throttling the sectional area of the intake passage thereby to guide the intake air to that of the first opening and the third opening, which is arranged on the more upstream side. According to this structure, the distribution of the intake air between the intake passage and the bypass intake passage can be adjusted by the bypass throttling portion.

According to the invention, it is possible to provide a resonator which can make the plural frequencies to be reduced in the sound-pressure level in the suction noises and the plural own resonance frequencies correspond to each other.

According to a third aspect of the invention, there is provided a resonator comprising a housing arranged in an intake member defining an intake passage, for defining a plurality of openings to communicate with the intake passage, and a silencer chamber to communicate with the plural openings, and a movable partition for switching a resonator mode, in which at least one volume portion to communicate with one of the openings is formed in the silencer chamber, and a bypass mode, in which a bypass portion to communicate with at least two of the openings is formed in the silencer chamber.

In the resonator mode, at least one volume portion is defined in the silencer chamber by the movable partition. This volume portion communicates with the single opening. In other words, at least one pair of the volume portion and the opening is formed. This pair of the volume portion and the opening acts as the resonator. This makes it possible to reduce the sound-pressure level of at least one frequency in the intake noises.

In the bypass mode, on the other hand, the bypass portion is defined in the silencer chamber by the movable partition. The bypass portion communicates with at least two openings. The intake air flows from the intake passage into the bypass portion through the upstream one of the plural openings. The intake air also flows from the bypass portion into the intake passage through the opening on the downstream side. Thus, in the bypass mode, there is formed the bypass intake passage composed of the intake passage→the opening on the upstream side→the bypass portion→the opening on the downstream side→the intake passage. In other words, there are retained the plural routes of the ordinary intake passage and that bypass intake passage. In the bypass mode, therefore, the intake air of a desired amount can be retained for the combustion chambers of the engine, even in case much intake air is necessary. Moreover, the sectional area of the bypass intake passage is locally expanded by the bypass portion. As a result, the bypass portion acts as the expansion chamber type resonator. This makes it possible to suppress the intake noises. Moreover, the parts number of the intake system can be made smaller than that of the case, in which the two intake systems are arranged in the engine room. Moreover, it is possible to reduce the manufacture cost. Still moreover, the space ratio of the engine room to be occupied by the intake system is reduced.

It is preferable that in the resonator mode, the movable partition partitions the silencer chamber movably into a plurality of the volume portions individually communicating with one of the openings.

The plural volume portions are movably partitioned by the movable partition. When the movable partition is moved, the volumes of the volume portions on the two sides of the movable partition vary. Specifically, the volume of one volume portion increases, but the volume of the other volume portion decreases. Here, the resonance frequency f on an arbitrary volume portion can be obtained for a sound velocity C, an opening area S of the opening communicating with the volume portion, a length L from the intake passage to the volume portion and a volume V of the volume portion from the following Formula:

$$f1 = \frac{C}{2\pi}\sqrt{\frac{S}{V \cdot L}} \quad \text{[Formula 4]}$$

From this Formula, the volume portion to be widened by the movement of the movable partition takes a lower resonance frequency. On the contrary, the volume portion to be narrowed by the movement of the movable partition takes a higher resonance frequency. Of the intake noises, the frequency to be reduced in the sound-pressure level is varied with the engine speed, According to this structure, therefore, it is possible to vary the resonance frequency relating to each volume portion in response to the engine speed, i.e., the frequency of the intake noises.

It is preferable that the resonator further comprises a movable cover associated, in the resonator mode, with the movable partition for changing the opening area of at least one of the plural openings.

According to this structure, in the resonator mode, the opening area S of the opening in the aforementioned Formula 4 can be varied. As compared with the case in which only the volume V of the volume portion can be changed, therefore, it is easier to adjust the resonance frequency relating to the volume portion and the frequency to be reduced in the sound-pressure level in the intake noises.

It is preferable that the plural openings include a first opening and a second opening that the plural volume portions in the resonator mode include a first volume portion communicating with the first opening and a second volume portion communicating with the second opening, that the resonator further comprises a movable cover associated, in the resonator mode, with the movable partition for changing the opening area of the second opening, and that the movable partition and the movable cover move, for the volume V1 of the first volume portion, the volume V2 of the second volume portion and the opening area S2 of the second opening, such that V1 decreases and such that S2/V2 increases in case the engine speed rises.

In the resonator mode, the resonance frequency f1 relating to the first volume portion 22 can be obtained for a sound velocity C, an opening area S1 of the first opening, a distance L1 from the intake passage to the first volume portion, and a volume V1 of the first volume portion from the following Formula:

$$f1 = \frac{C}{2\pi}\sqrt{\frac{S1}{V1 \cdot L1}} \quad \text{[Formula 5]}$$

As the engine speed rises, the frequency F1 to be reduced in the sound-pressure level in the intake noises rises. In the case of this structure, on the contrary, as the engine speed rises, the volume V1 of the first volume portion 22 lowers. As a result, the resonance frequency f1 rises. Therefore, the shifting direction of the frequency F1 of the intake noises and the shifting direction of the resonance frequency f1 align with each other.

In the resonator mode, too, a resonance frequency f2 relating to the second volume portion can be obtained for the sound velocity C, an opening area S2 of the second opening, a distance L2 from the intake passage to the second volume portion and a volume V2 of the second volume portion from the following Formula:

$$f2 = \frac{C}{2\pi}\sqrt{\frac{S2}{V2 \cdot L2}} \quad \text{[Formula 6]}$$

If the sum of the volume of the first volume portion and the volume of the second volume portion is designated by Vt, a relation of Vt=V1+V2 holds.

As the engine speed rises, the frequency F2 to be reduced in the sound-pressure level in the intake noises rises. In the case of this structure, on the contrary, as the engine speed rises, the volume V1 of the first volume portion lowers so that the volume V2 (=Vt−V1) of the second volume portion 23 inevitably rises. Here, the opening area S2 of the second opening increases together with the volume V2. At the same time, the volume V2 and the opening area S2 are so set that the ratio of S2/V2 rises. As a result, the resonance frequency f2 rises. This aligns the shifting direction of the frequency F2 of the intake noises and the shifting direction of the resonance frequency f2 with each other.

Thus, according to this structure, the two resonance frequencies f1 and f2 can be shifted in the same direction as the engine speed changes. Specifically, in case the engine speed is high (i.e., in case the frequencies F1 and F2 of the intake noises are high), the resonance frequencies f1 and f2 can be set to a high-frequency range. In case the engine speed is low (i.e., in case the frequencies F1 and F2 of the intake noises are low), the resonance frequencies f1 and f2 can be set to a low-frequency range. In the resonator mode, according to this structure, the two frequencies to be reduced in the sound-pressure level in the intake noises and the two resonance frequencies are easily made to correspond to each other.

It is preferable that the resonator further comprises a cylindrical member for defining a communicating portion between at least one of the plural openings and the silencer chamber. In other words, according to this structure, in the resonator mode, the Helmholtz type resonator is formed of the opening and the volume portion defining portion in the housing and the cylindrical member defining the communication portion. This Helmholtz type resonator has a large width for reducing the sound-pressure level. According to this structure, therefore, it is possible to reduce the sound-pressure level of the desired frequency drastically.

It is preferable that at least one of the plural openings has a slit shape. According to this structure, in the resonator mode, the cavity type resonator is formed by the slit-shaped opening and the volume portion defining portion in the housing. The cavity type resonator has a wide frequency range for reducing the sound-pressure level. According to this structure, therefore, it is possible to reduce the sound-pressure level of the wide frequency range containing the desired frequency.

It is preferable that at least one of the plural openings is formed of a pore group having a multiplicity of pores. According to this structure, in the resonator mode, the cavity type resonator is formed of the pore group and the volume portion defining portion in the housing. The cavity type resonator has a wide frequency range for reducing the sound-pressure level. According to this structure, therefore, it is possible to reduce the sound-pressure level of the wide frequency range containing the desired frequency.

It is preferable that the movable partition includes a communication aperture for providing the communication between the surface side and the back side of itself, and that the resonator further comprises an air-permeable member for closing the communication aperture. FIG. 18 illustrates a schematic diagram for reducing a sound-pressure level. When the sound-pressure level of an arbitrary frequency is reduced, as shown, anti-resonant portions (as hatched) having high sound-pressure levels may be manifested on the low-frequency side and the high-frequency side of that frequency. In view of this point, the air-permeable member is arranged in the communication aperture of the movable partition of this structure. The manifest of the anti-resonant portion can be suppressed by arranging the air-permeable member.

It is preferable that the resonator further comprises a bypass throttling portion arranged in the intake member between the portions, in which arbitrary two of the plural openings are opened, for throttling the sectional area of the intake passage thereby to guide the intake air to that of the openings, which is arranged on the more upstream side. According to this structure, in the bypass mode, the distribution of the intake air between the intake passage and the bypass intake passage can be adjusted by the bypass throttling portion.

According to the invention, it is possible to provide a resonator which can increase/decrease the number of passages for intake air in response to an engine speed.

DETAILED DESCRIPTION OF THE PREFERRED EMBODIMENTS

Embodiments of the invention will be described in the following.

FIRST EMBODIMENT

Figure 1:
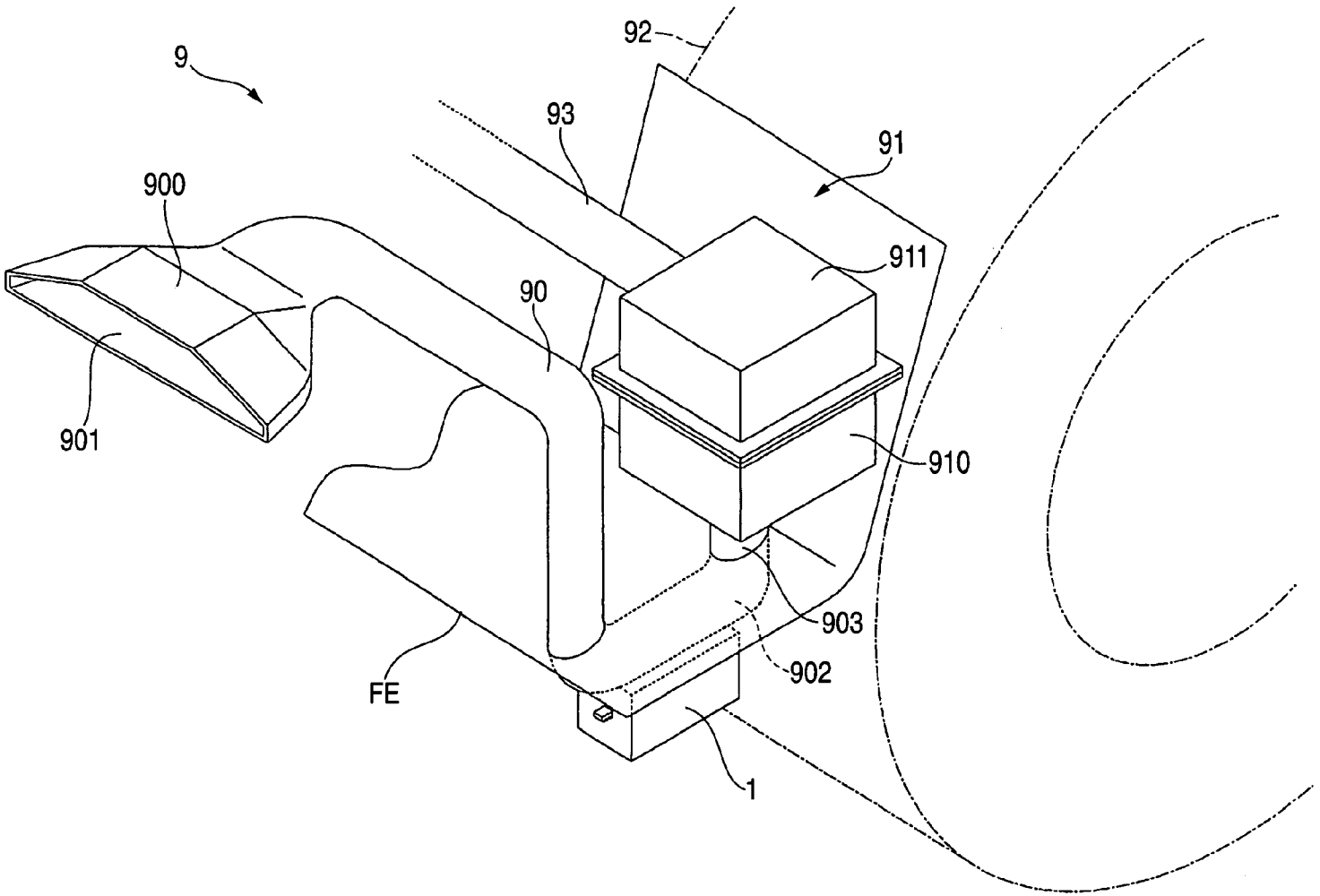
FIG. 1 is a perspective view of an intake system, in which a resonator of a first embodiment is arranged.

A first description is made on an intake system, in which a resonator of this embodiment is arranged. FIG. 1 is a perspective view of the intake system, in which the resonator of this embodiment is arranged. As shown in FIG. 1, an intake system 9 is provided with an intake duct 90, an air cleaner 91 and an air cleaner hose 93. An intake passage is defined in the intake system 9. The intake duct 90 and the air cleaner 91 are arranged in a space in front of front tires 92 (as indicated by single-dotted lines) of a vehicle.

The intake duct 90 is made of PP (Polypropylene) into a cylindrical shape. The intake duct 90 is included in an intake member of the invention. The intake duct 90 has its upstream side end portion 900 formed into a flattened trapezoidal shape. An intake port 901 is opened in the upstream side end portion 900. This upstream side end portion 900 is fastened on the (not-shown) radiator upper support. The intake duct 90 is curved into a U-shape. The U-shaped bottom portion 902 of the intake duct 90 is arranged below a fender apron FE.

The air cleaner 91 is provided with a dirty side case 910 and a clean side case 911. The dirty side case 910 is made of PP blended with talc into a box shape opened upward. The intake duct 90 is connected at its downstream side end portion 903 to the dirty side case 910. The clean side case 911 is made of PF blended with talc into a box shape opened downward. The clean side case 911 is so arranged over the dirty side case 910 that their openings mate with each other. Between the dirty side case 910 and the clean side case 911, there is sandwiched the (not-shown) air element which is prepared by gusseting nonwoven PET (polyethylene terephthalate) fabric.

The air cleaner hose 93 is made of CR (chloroprene rubber) into the (not-shown) cylindrical bellows. The air cleaner hose 93 is connected at its upstream side end portion to the clean side case 911. On the other hand, the air cleaner hose 93 is connected at its downstream side end portion to the (not-shown) inlet manifold. A resonator 1 is arranged on the U-shaped bottom portion 902 of the intake duct 90. The intake air is introduced from the intake port 901 into the intake duct 90 and is filtered through the air cleaner 91 so that it is fed to the combustion chamber of an engine through the air cleaner hose 93 and an inlet manifold.

Figure 2:
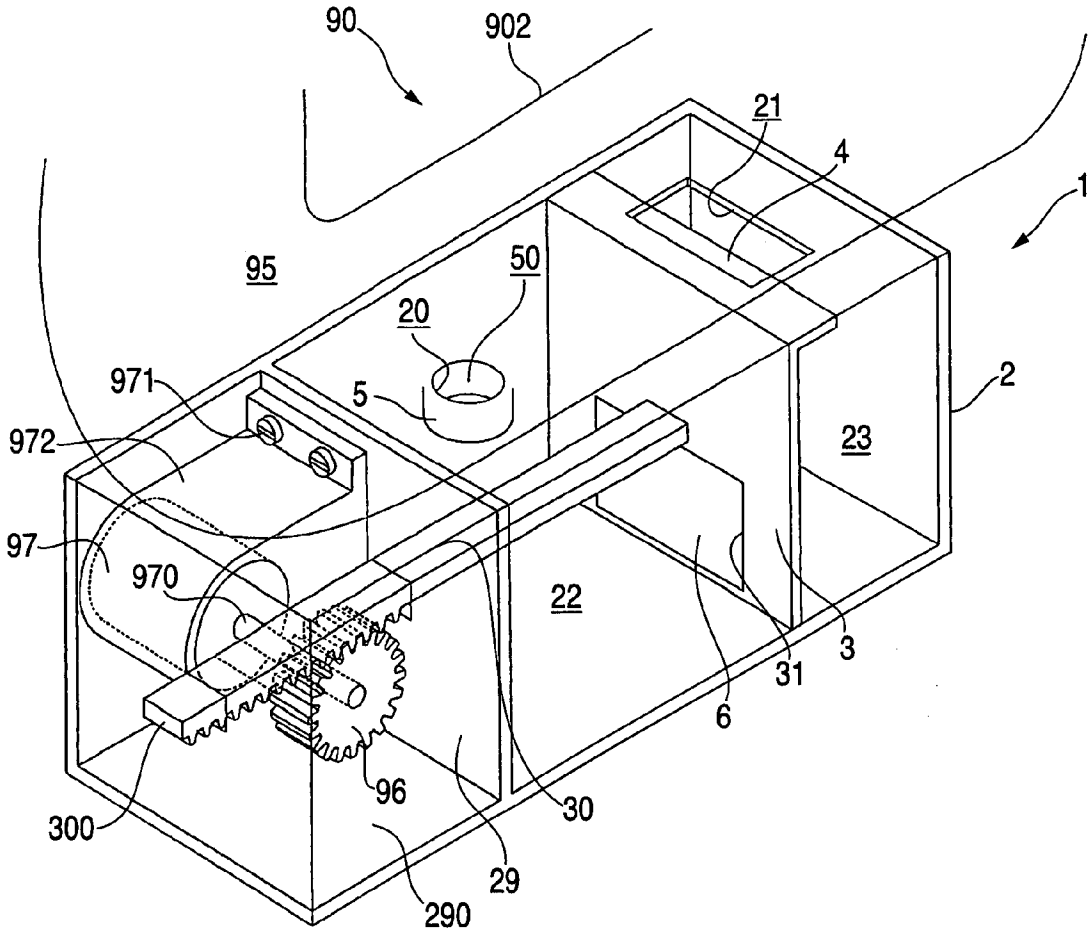
FIG. 2 is a transparent, perspective view of the same resonator.
Figure 3:
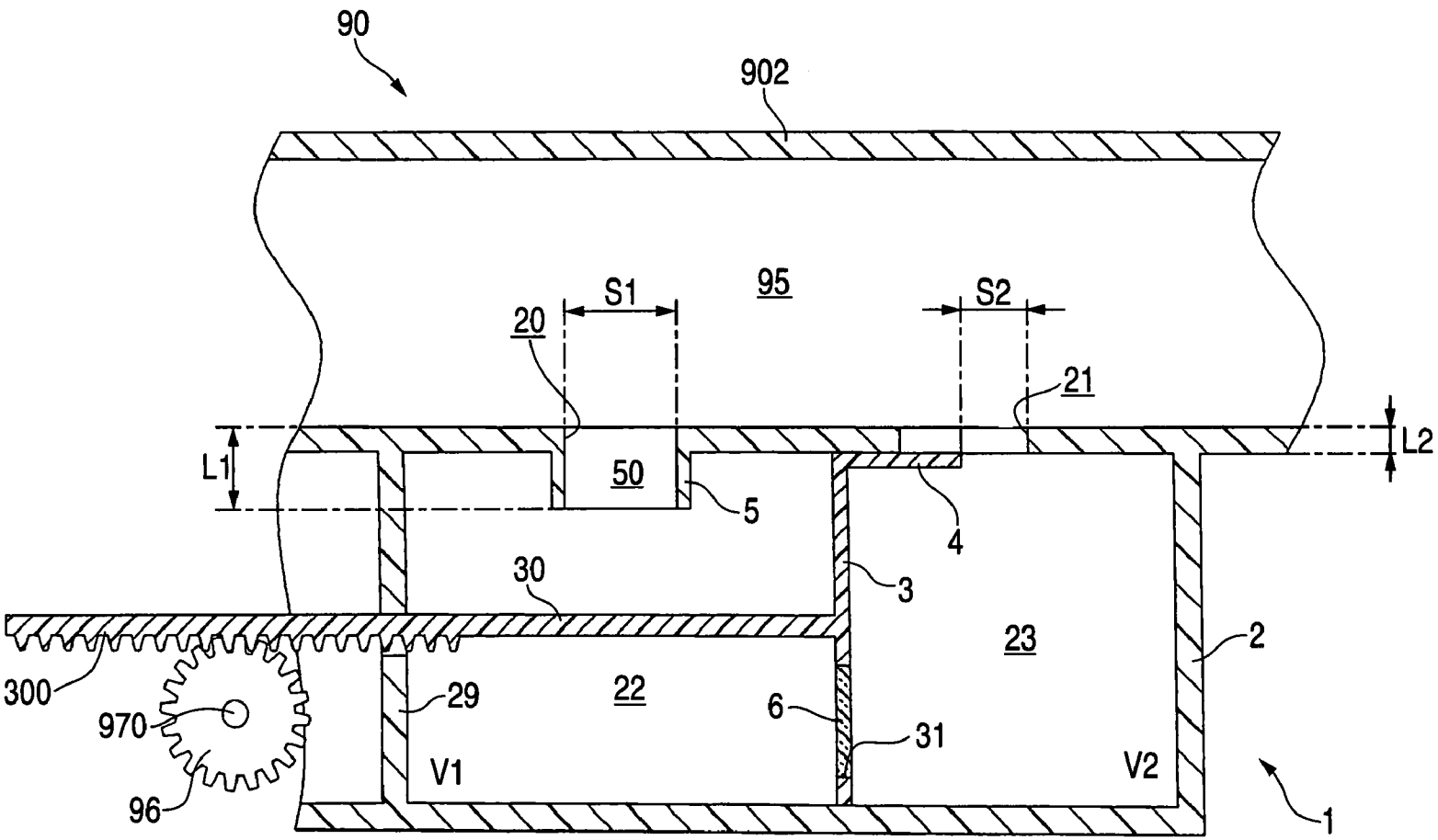
FIG. 3 is a longitudinal section of the same resonator.

Here is described a structure of the resonator of this embodiment. FIG. 2 is a transparent, perspective view of the resonator of this embodiment. FIG. 3 is a longitudinal section of the same resonator. A motor housing chamber, a holder and a screw are omitted from FIG. 3. As shown in FIGS. 2 and 3, the resonator 1 is provided with a housing 2, a movable partition 3, a movable cover 4, a cylindrical portion 5 and an air-permeable member 6.

The housing 2 is made of PP into a box shape. The housing 2 is made integral with the lower wall of the U-shaped bottom portion 902 of the intake duct 90. In the upper wall of the housing 2 (or in the lower wall of the U-shaped bottom portion 902), there is formed a first round opening 20. This first opening 20 communicates with an intake passage 95 in the U-shaped bottom portion 902. In the upper wall of the housing 2 on the downstream side of the first opening 20, there is opened a slit 21. This slit 21 is contained in the second opening of the invention. The slit 21 is formed in a wide rectangular shape with respect to the moving direction of the later-described movable partition 3. The slit 21 communicates with the intake passage 95 in the U-shaped bottom portion 902.

The cylindrical portion 5 is made of PP into an axially short cylindrical shape. The cylindrical portion 5 is protruded downward from the lower face of the upper wall of the housing 2. The cylindrical portion 5 is arranged on the outer circumference side of the first opening 20. The cylindrical portion 5 defines a communication portion 50 on its inner circumference side. The communication portion 50 communicates with the first opening 20.

The movable partition 3 is made of PP into a rectangular plate shape. The movable partition 3 is fitted on its outer edge with the (not-shown) seal frame of rubber. The movable partition 3 partitions the inside of the housing 2 into a first volume portion 22 and a second volume portion 23. The first volume portion 22 communicates with the communication portion 50. On the other hand, the second volume portion 23 communicates with the slit 21. The movable partition 3 can change the volume of the first volume portion 22 and the volume of the second volume portion 23. From the general center of the surface of the movable partition 3 on the side of the first volume portion 22, there is protruded a rod 30 having a thin plate shape. This rod 30 extends through a motor fixing wall 29 of the housing 2. A rack portion 300, as formed on the through end of the rod 30, meshes in a motor housing chamber 290 with a pinion 96. This pinion 96 is fastened on a spindle 970 of a motor 97. This motor 97 is housed in a holder 972. This holder 972 is fastened on the motor fixing wall 29 by screws 971. A rectangular communication aperture 31 is opened in the movable partition 3 below the root portion of the rod 30.

The air-permeable member 6 is made of nonwoven PET fabric into a rectangular plate shape. The air-permeable member 6 closes the communication aperture 31. Microscopically, therefore, the first volume portion 22 and the second volume portion 23 communicate with each other through the air-permeable member 6.

The movable cover 4 is made of PP into a rectangular plate shape. The movable cover 4 is protruded just like a penthouse from the upper edge of the movable partition 3 toward the second volume portion 23. The movable cover 4 is arranged below the slit 21. As a result, the opening area of the slit 21 can be changed by the movable cover 4.

Here are described the actions of the case, in which the engine speed of the resonator of this embodiment is raised. Of FIGS. 4A and 4B presenting schematic diagrams of the resonator of this embodiment, FIG. 4A shows the case, in which the engine speed is low, and FIG. 4B shows the case, in which the engine speed is high.

Figure 4A:
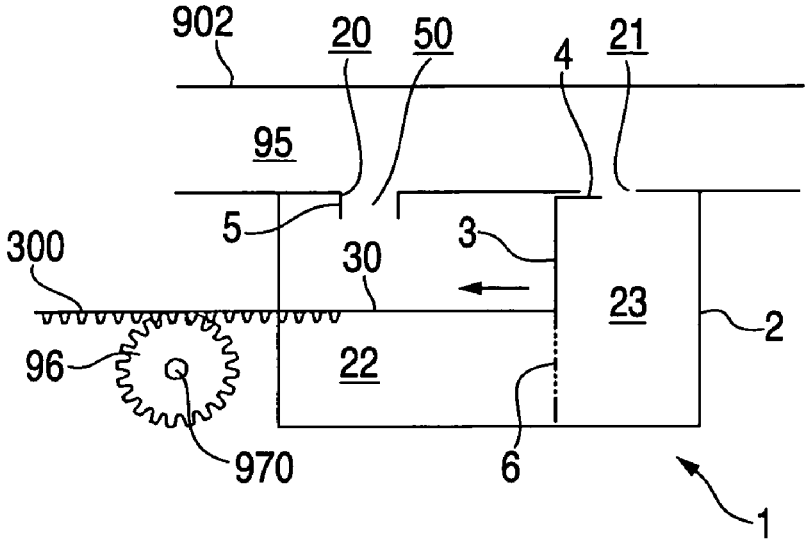
FIG. 4A is a schematic diagram of the same resonator of the case, in which an engine speed is low.

In case the engine speed is low, as shown in FIG. 4A, the first volume portion 22 has a relatively larger volume. On the other hand, the second volume portion 23 has a relatively smaller volume. Moreover, the slit 21 has a relatively smaller opening area.

When the engine speed rises, the (not-shown) controller rotates the spindle 970 of the motor 97 (as referred to FIG. 2) in response to a signal coming from the (not-shown) speed sensor. The spindle 970 of the motor 97 is fastened in the pinion 96. As a result, the pinion 96 rotates together with the spindle 970. The pinion 96 meshes with the rack portion 300 of the rod 30. When the pinion 96 rotates, therefore, the rod 30 is pulled by the pinion 96. As a result, the movable partition 3 and the movable cover 4 move toward the first volume portion 22.

Figure 4B:
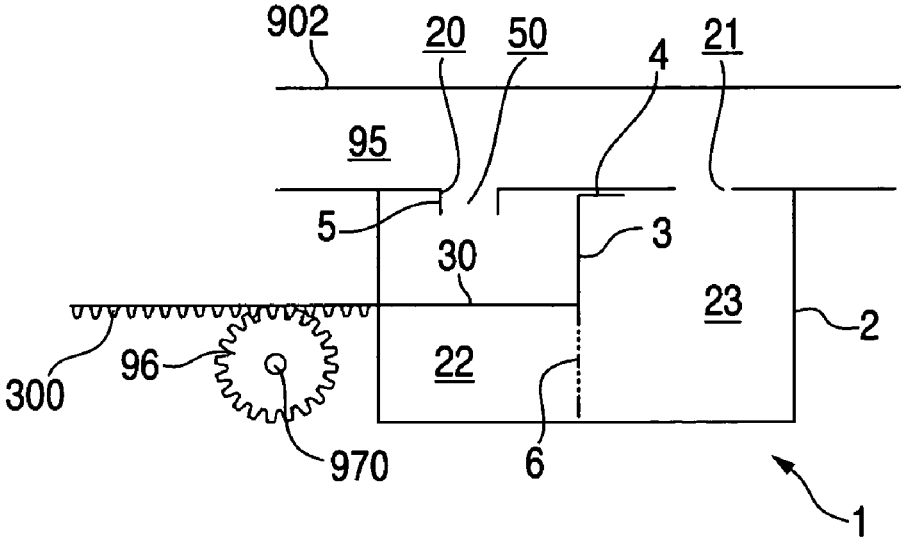
FIG. 4B is a schematic diagram of the same resonator of the case; in which the engine speed is high.

As the movable partition 3 and the movable cover 4 move toward the first volume portion 22, as shown in FIG. 4B, the first volume portion 22 becomes small. As shown in FIG. 3, a resonance frequency f1 relating to the first volume portion 22, the communication portion 50 and the first opening 20 can be obtained for a sound velocity C, an opening area S1 of the first opening 20, an axial length L1 of the cylindrical portion 5 and a volume V1 of the first volume portion 22 from the following Formula:

$$f1 = \frac{C}{2\pi}\sqrt{\frac{S1}{V1 \cdot L1}} \quad \text{[Formula 7]}$$

As the engine speed rises, the frequency F1 of intake noises rises. As the engine speed rises, on the contrary, the volume V1 of the first volume portion 22 lowers. As a result, the resonance frequency f1 rises.

Likewise, a resonance frequency f2 relating to the second volume portion 23 and the slit 21 can be obtained for the sound velocity C, an opening area S2 of the slit 21, a thickness L2 of the upper wall of the housing 2 and a volume V2 of the second volume portion 23 from the following Formula:

$$f2 = \frac{C}{2\pi}\sqrt{\frac{S2}{V2 \cdot L2}} \quad \text{[Formula 8]}$$

If the sum of the volume of the first volume portion 22 and the volume of the second volume portion 23 is designated by Vt, a relation of Vt=V1+V2 holds.

As the engine speed rises, the frequency F2 of the intake noises rises. As the engine speed rises, on the contrary, the volume V1 of the first volume portion 22 lowers so that the volume V2 (=Vt−V1) of the second volume portion 23 inevitably rises. On the other hand, the opening area S2 of the slit 21 increases according to the movement of the movable cover 4. At the same time, the volume V2 and the opening area 32 are so set that the ratio of S2/V2 rises. As a result, the resonance frequency f2 rises. 7n case the engine speed lowers, the movable partition 3 and the movable cover 4 are moved toward the second volume portion 23.

Here are described the actions and effects of the resonator of this embodiment. According to the resonator 1 of this embodiment, it is possible to change not only the volume V1 of the first volume portion 22 and the volume V2 of the second volume portion 23 but also the opening area S2 of the slit 21. As a result, it is easy to bring the two frequencies F1 and F2, for which the sound-pressure levels in the intake noises are to be reduced, and the two resonance frequencies f1 and f2 of the resonator 1 into correspondence with each other.

According to the resonator 1 of this embodiment, moreover, a Helmholtz type resonator is formed by the portions defining the first opening 20 and the first volume portion 22 in the housing 2 and by the cylindrical portion 5 defining the communication portion 50. The Helmholtz type resonator has a large width for reducing the sound-pressure level. According to the resonator 1 of this embodiment, therefore, the sound-pressure level of a desired frequency can be drastically lowered.

According to the resonator 1 of this embodiment, moreover, the two resonance frequencies f1 and f2 can be shifted in the same direction as the engine speed changes. Specifically, in case the engine speed is high (i.e., in case the frequencies F1 and F2 of the intake noises are high), the resonance frequencies f1 and f2 can be set to a high-frequency range. In case the engine speed is low (i.e., in case the frequencies F1 and F2 of the intake noises are low), the resonance frequencies f1 and f2 can be set to a low-frequency range.

According to the resonator 1 of this embodiment, moreover, a cavity type resonator portion is formed by the portion of the housing 2 defining the slit 21 and the second volume portion 23. The cavity type resonator has a wide frequency with for reducing the sound-pressure level. According to the resonator 1 of this embodiment, therefore, it is possible to reduce the sound-pressure level of a wide frequency range including a desired frequency.

According to the resonator 1 of this embodiment, moreover, the air-permeable member 6 is arranged in the communication aperture 31 of the movable partition 3. As a result, it is possible to prevent an anti-resonant portion of a high sound-pressure level from being manifested on the lower side and the higher side of the frequency having the reduced sound-pressure level.

SECOND EMBODIMENT

This embodiment is different from the first embodiment in that a group of multiple pores is formed in place of the slit in the upper wall of the housing. Therefore, the following description is made exclusively on the difference.

Figure 5:
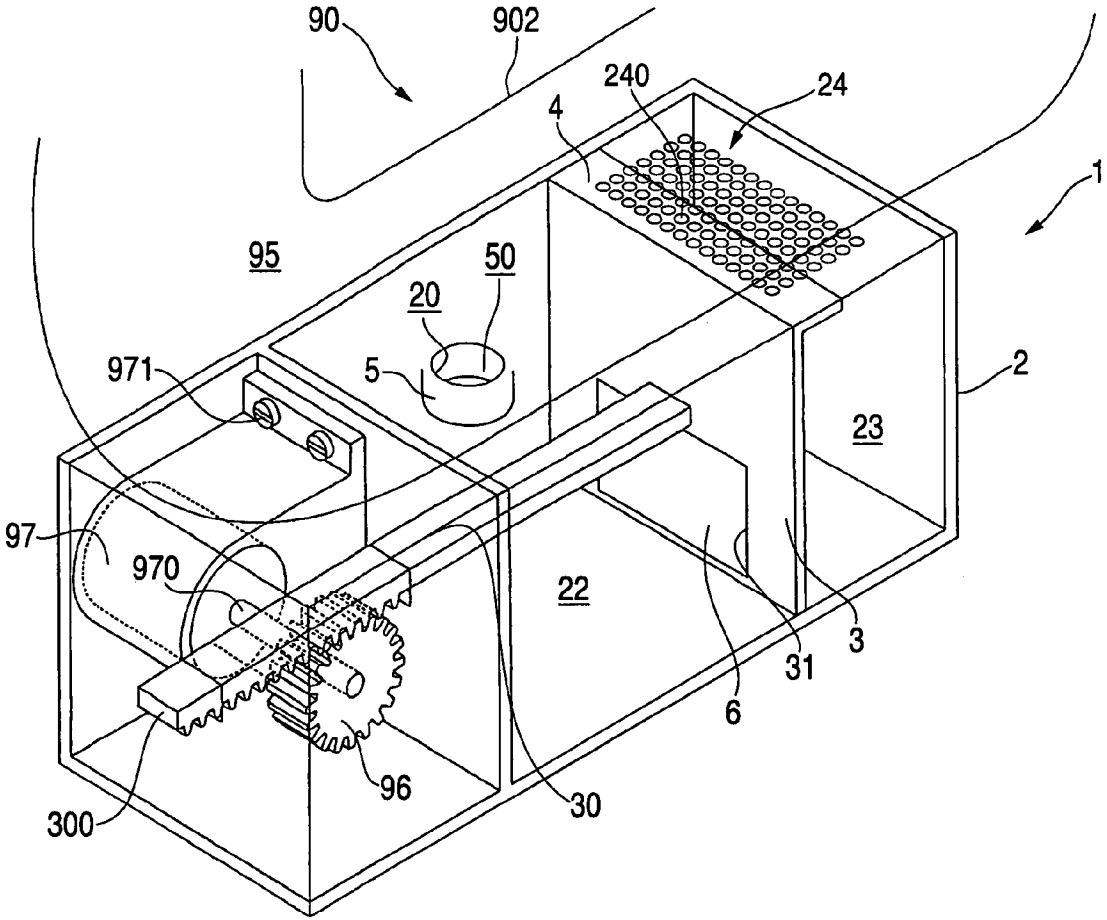
FIG. 5 is a transparent, perspective view of a resonator of a second embodiment.

FIG. 5 is a transparent, perspective view of a resonator of this embodiment. Here, the portions corresponding to those of FIG. 2 are designated by the common reference numerals. As shown, small pores 240 are formed in the upper wall of the housing 2. These pores 240 provide communication between the intake passage 95 and the second volume portion 23. The multiple pores 240 make up a pore group 24. This pore group 24 is arranged widely with respect to the moving direction of the movable partition 3. The resonator 1 of this embodiment has actions and effects similar to those of the resonator of the first embodiment.

THIRD EMBODIMENT

This embodiment is different from the first embodiment in that the movable partition and the movable cover are moved by the intake vacuum. Another difference resides in that the first volume portion and the second volume portion, and the first opening and the slit are individually arranged reversely with respect to the intake flow direction. Therefore, the description is made exclusively on the differences.

Figure 6:
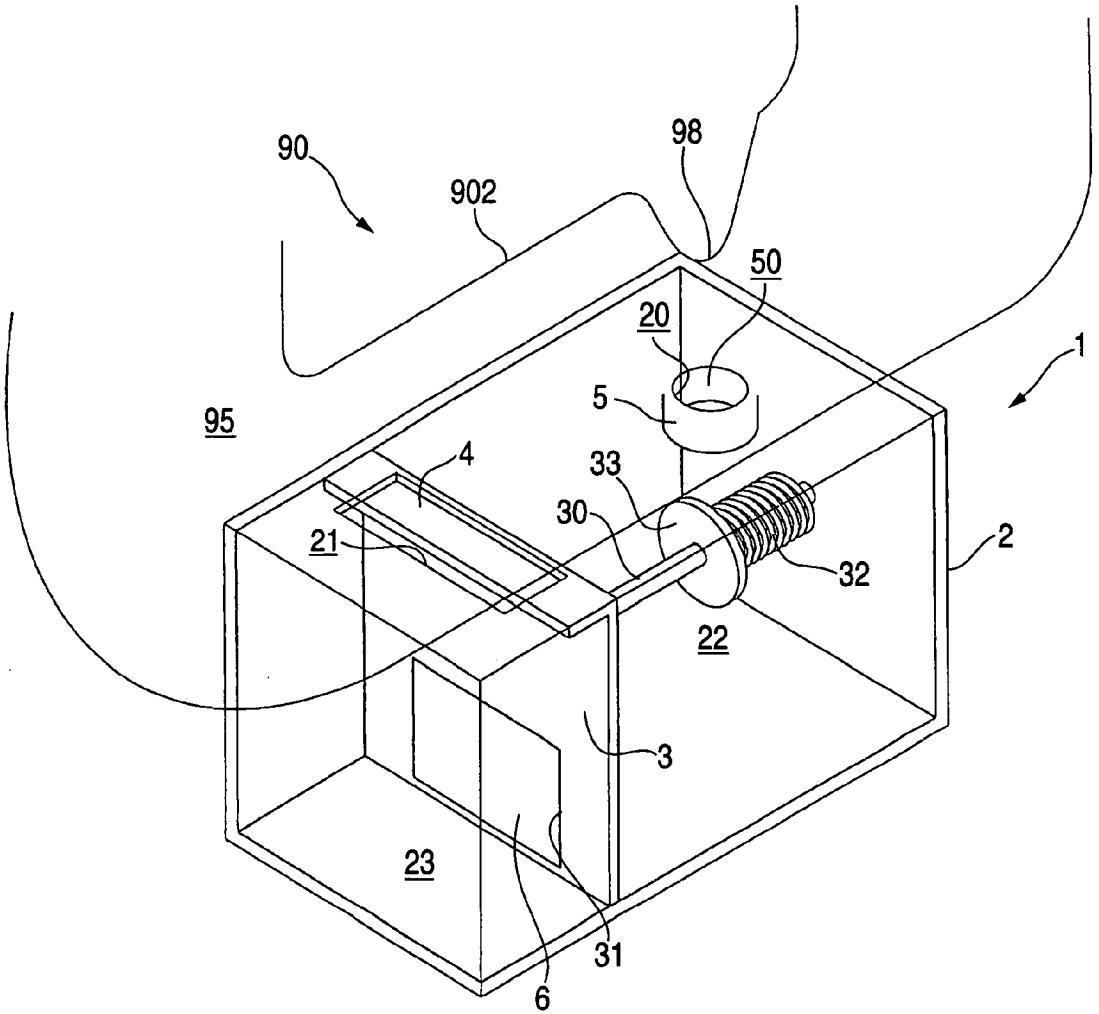
FIG. 6 is a transparent, perspective view of a resonator of a third embodiment.

FIG. 6 is a transparent, perspective view of a resonator of this embodiment. Here, the portions corresponding to those of FIG. 2 are designated by the common reference numerals. The upper wall of the U-shaped bottom portion 902 of the intake duct 90 is recessed to form a differential pressure throttling portion 98. This differential pressure throttling portion 98 reduces the sectional area of the intake passage 95 locally.

In the upper wall of the housing 2, the first opening 20 is opened to confront the differential pressure throttling portion 98 vertically. The cylindrical portion 5 is protruded from the lower face of the upper wall of the housing 2. The communication portion 50 is defined on the inner circumference side of the cylindrical portion 5. The inside space of the housing 2 is partitioned by the movable partition 3 into the second volume portion 23 on the upstream side and the first volume portion 22 on the downstream side. The communication portion 50 communicates with the first volume portion 22. The slit 21 is opened in the upper wall of the housing 2 on the upstream side of the first opening 20. The slit 21 communicates with the second volume portion 23.

The rod 30 of a round bar shape is protruded from the general center of the surface of the movable partition 3 on the side of the first volume portion 22. The rod 30 extends through the side wall of the housing 2. A flange-shaped stopper 33 is mounted around the intermediate portion of the rod 30. A coil spring 32 of steel is sandwiched between the stopper 33 and the inner face of the side wall of the housing 2. The movable cover 4 is protruded from the upper edge of the movable partition 3 toward the second volume portion 23. The movable cover 4 is arranged below the slit 21.

Figure 7A:
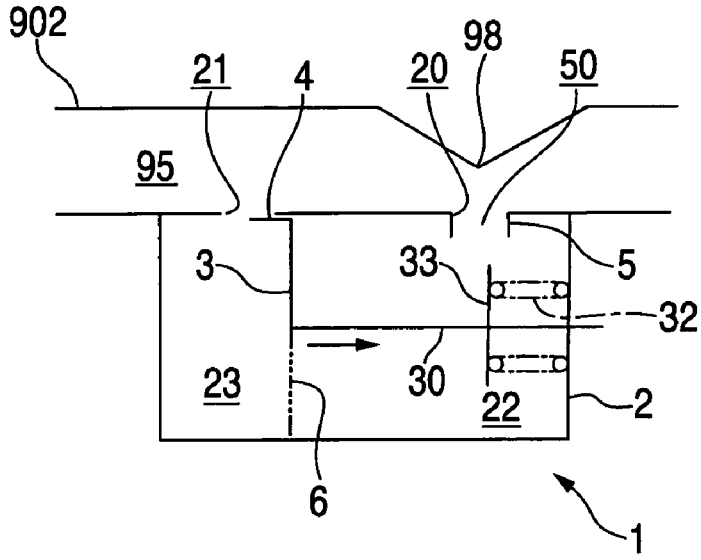
FIG. 7A is a schematic diagram of the same resonator of the case, in which the engine speed is low.
Figure 7B:
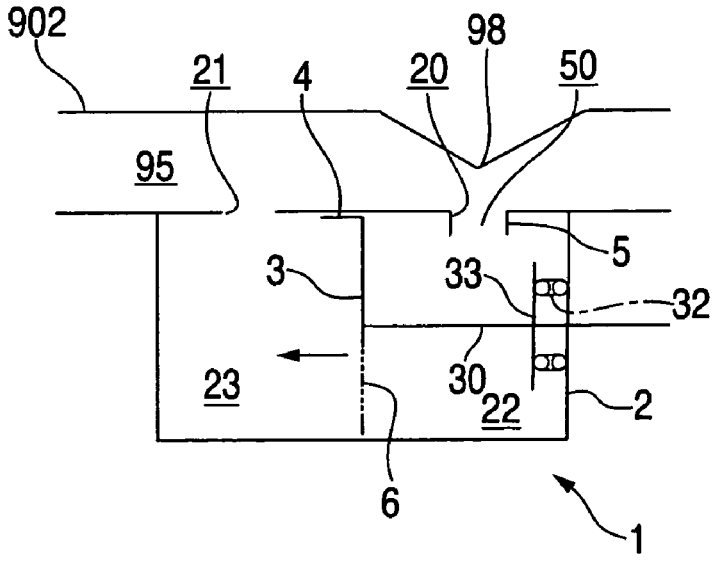
FIG. 7B is a schematic diagram of the same resonator of the case, in which the engine speed is high.

Of FIGS. 7A and 7B presenting schematic diagrams of the resonator of this embodiment, FIG. 7A shows the case, in which the engine speed is low, and FIG. 7B shows the case, in which the engine speed is high. The portions corresponding to those of FIG. 4 are designated by the common reference numerals.

In case the engine speed is low, as shown in FIG. 7A, the first volume portion 22 has a relatively large volume. On the other hand, the second volume portion 23 has a relatively small volume. Moreover, the slit 21 has a relatively small opening area.

As the engine speed becomes higher, the intake air to flow through the differential pressure throttling portion 98 takes a higher flow velocity. As a result, the vicinity of the first opening 20 is evacuated. The first opening 20 and the first volume portion 22 are made to communicate through the communication portion 50. As a result, the first volume portion 22 is also evacuated. When the first volume portion 22 is evacuated, the internal pressure of the first volume portion 22 becomes lower than that of the second volume portion 23. As shown in FIG. 7B, therefore, the movable partition 3 and the movable cover 4 move toward the first volume portion 22. As a result, the volume of the first volume portion 22 decreases. On the other hand, the volume the second volume portion 23 increases. At the same time, the opening area of the slit 21 increases.

As the engine speed becomes lower, on the contrary, the intake air to flow through the differential pressure throttling portion 98 takes a lower flow velocity. As a result, the differential pressure throttling portion 98 between the internal pressure of the first volume portion 22 and the internal pressure of the second volume portion 23 becomes lower. By the biasing force of the coil spring 32, therefore, the movable partition 3 and the movable cover 4 move again toward the second volume portion 23. In short, the state returns to that of FIG. 7A. As a result, the volume of the first volume portion 22 increases. On the other hand, the volume of the second volume portion 23 decreases. At the same time, the opening area of the slit 21 decreases.

The resonator 1 of this embodiment achieves the actions and effects similar to those of the resonator of the first embodiment. According to the resonator 1 of this embodiment, the movable partition 3 and the movable cover 4 can be moved by the relatively simple method of providing the differential pressure throttling portion 98. At the same time, it is possible to dispense with the driving parts such as the motor, the speed sensor and the controller for moving the movable partition 3 and the movable cover 4. As a result, it is possible to reduce the cost for manufacturing the resonator 1. Moreover, the structure of the resonator 1 is simplified. According to the resonator 1 of this embodiment, moreover, the coil spring 32 is housed in the first volume portion 22. As a result, the coil spring 32 can be prevented from being rusted or frozen.

FOURTH EMBODIMENT

The difference between this embodiment and the first embodiment resides in that a third opening is formed in the upper wall of the housing, Therefore, the description is made exclusively on difference.

Figure 8A:
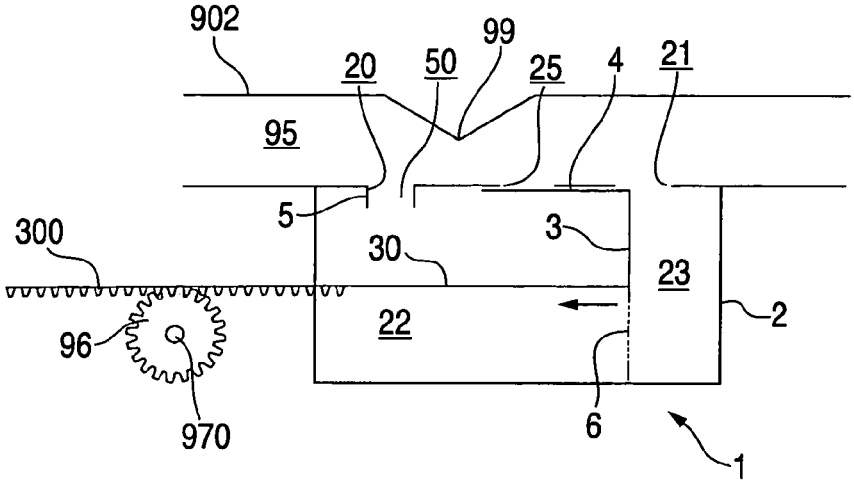
FIG. 8A is a schematic diagram of a resonator of a fourth embodiment of the case, in which the engine speed is low.
Figure 8B:
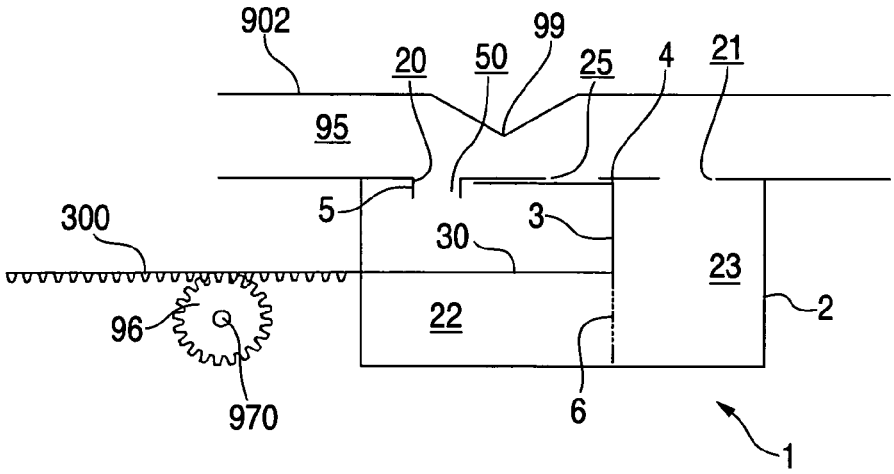
FIG. 8B is a schematic diagram of the same resonator of the case, in which the engine speed is intermediate.
Figure 8C:
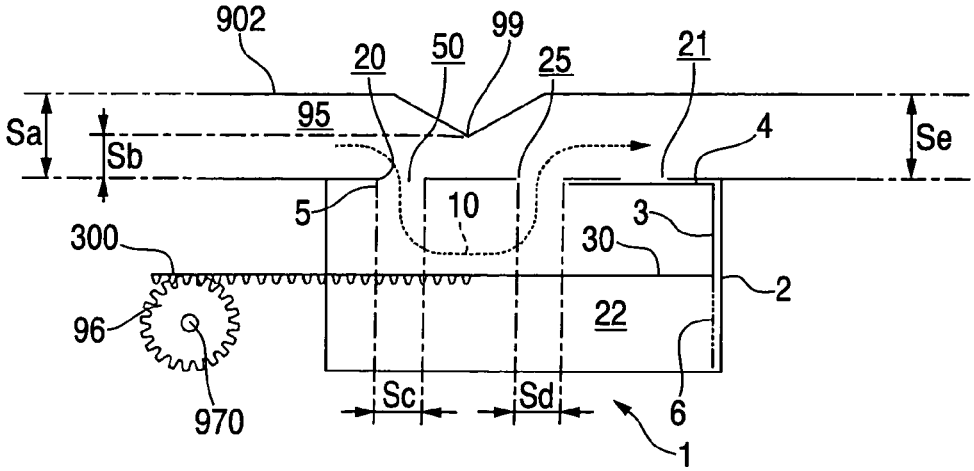
FIG. 8C is a schematic diagram of the same resonator of the case, in which the engine speed is high.

Of FIGS. 8A to 8C presenting schematic diagrams of the resonator of this embodiment, FIG. 8A shows the case, in which the engine speed is low; FIG. 8B shows the case, in which the engine speed is intermediate; and FIG. 8C shows the case, in which the engine speed is high. The portions corresponding to those of FIG. 4 are designated by the common reference numerals.

In the upper wall of the housing 2, as shown, the first opening 20, a third opening 25 and the slit 21 are opened in series along the flow direction of the intake air. The third opening 25 has a circular shape. The U-shaped bottom portion 902 of the intake duct is recessed 5 to form a bypass throttling portion 99. By this bypass throttling portion 99, the sectional area of the intake passage 95 is locally reduced. The bypass throttling portion 99 is arranged between the first opening 20 and the third opening 25.

In case the engine speed is low, as shown in FIG. 8A, the first volume portion 22 has a relatively large volume. On the other hand, the second volume portion 23 has a relatively small volume. Moreover, the slit 21 has a relatively small opening area. On the other hand, the third opening 25 is closed with the movable cover 4.

As the engine speed rises, the (not-shown) controller causes the spindle 970 of the motor 97 (as referred to FIG. 2) to rotate in response to the signal coming from the (not-shown) speed sensor. As a result, the pinion 96 also rotates. As the pinion 96 rotates, the rod 30 is pulled by the pinion 96. Therefore, the movable partition 3 and the movable cover 4 move toward the first volume portion 22.

As the movable partition 3 and the movable cover 4 move toward the first volume portion 22, as shown in FIG. 8B, the volume of the first volume portion 22 decreases. On the other hand, the volume of the second volume portion 23 increases. Moreover, the opening area of the slit 21 increases. In case the engine speed lowers, the movable partition 3 and the movable cover 9 are moved toward the second volume portion 23. Thus, the resonator 1 of this embodiment acts like the resonator of the first embodiment, in case the engine speed is from low to intermediate.

In case the engine speed is high, on the other hand, the movable partition 3 is moved largely to the second volume portion, as shown in FIG. 8C. Then, the slit 21 is closed in its entirety with the movable cover 4. On the contrary, the third opening 25 is opened by the movement of the movable cover 4. Then, there is formed a bypass intake passage 10, which connects the first opening 20, the communication portion 50, the first volume portion 22 and the third opening 25.

The resonator 1 of this embodiment has actions and effects similar to those of the resonator of the first embodiment, in case the engine speed is from low to intermediate. In case the engine speed is high, according to the resonator of this embodiment, the first volume portion 22 takes the larger volume as it occupies the closer to the entirety of the inside space of the housing 2. As a result, the first volume portion 22 functions as an expansion chamber type resonator. In case the engine speed is high, therefore, the sound-pressure level in a high-frequency range can be reduced.

According to the resonator 1 of this embodiment, moreover, the bypass intake passage 10 is opened in case the engine speed is high. This makes it possible to retain the dual intake passages 95 and 10. Therefore, the number of parts for the intake system can be less than that of the case, in which two intake systems are separately and independently arranged in the engine room. Moreover, it is possible to reduce the manufacture cost. Still moreover, the space ratio of the engine room to be occupied by the intake system is reduced.

In the U-shaped bottom portion 902 of the intake duct, according to the resonator 1 of this-embodiment, the bypass throttling portion 99 is arranged between the portion, in which the first opening 20 is opened, and the portion, in which the third opening 25 is opened. As a result, the intake air can be easily shunted to the bypass intake passage 10, in case the engine speed is high.

According to the resonator 1 of this embodiment, moreover, the sectional area Sa of the upstream side passage of the U-shaped bottom portion 902, the sectional area Se of the downstream side passage, the sectional area Sb of the passage of the bypass throttling portion 99, the opening area Sc of the first opening 20 and the opening area Sd of the third opening 25 are set to satisfy the relations of $Sa \leqq Sb+Sc$ and $Sa \leqq Sd+Se$ (as referred to FIG. 8C). These relations reduce the ventilation resistance.

FIFTH EMBODIMENT

This embodiment is different from the first embodiment in that the movable partition and the movable cover are moved by the intake vacuum. Another difference resides in that the housing has a cylindrical shape. Specifically, the first volume portion and the second volume portion are arranged in a circular graph shape. Therefore, the description is made exclusively on the differences.

Figure 9:
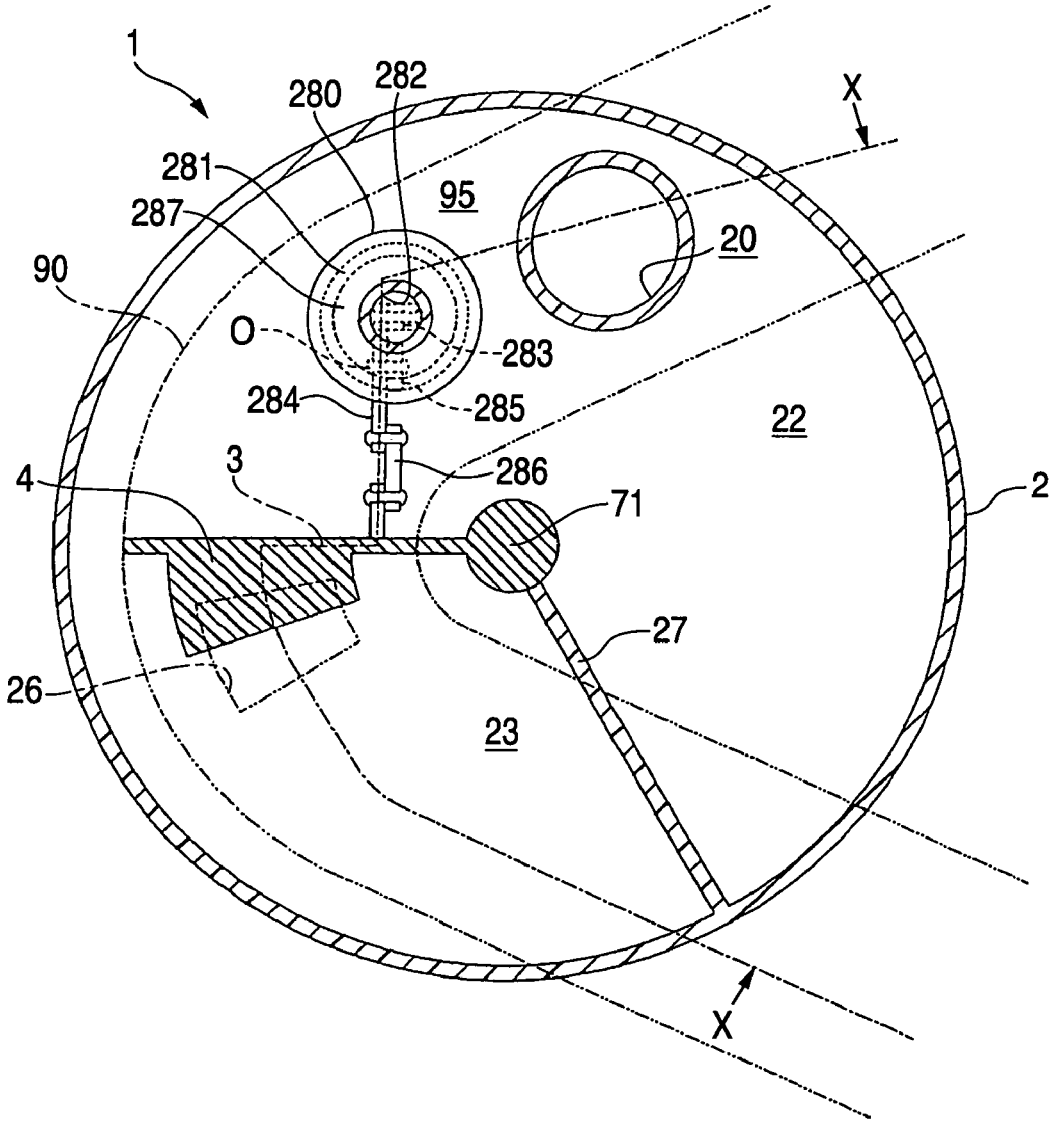
FIG. 9 is a sectional top plan view of a resonator of a fifth embodiment of the case, in which the engine speed is low.
Figure 10:
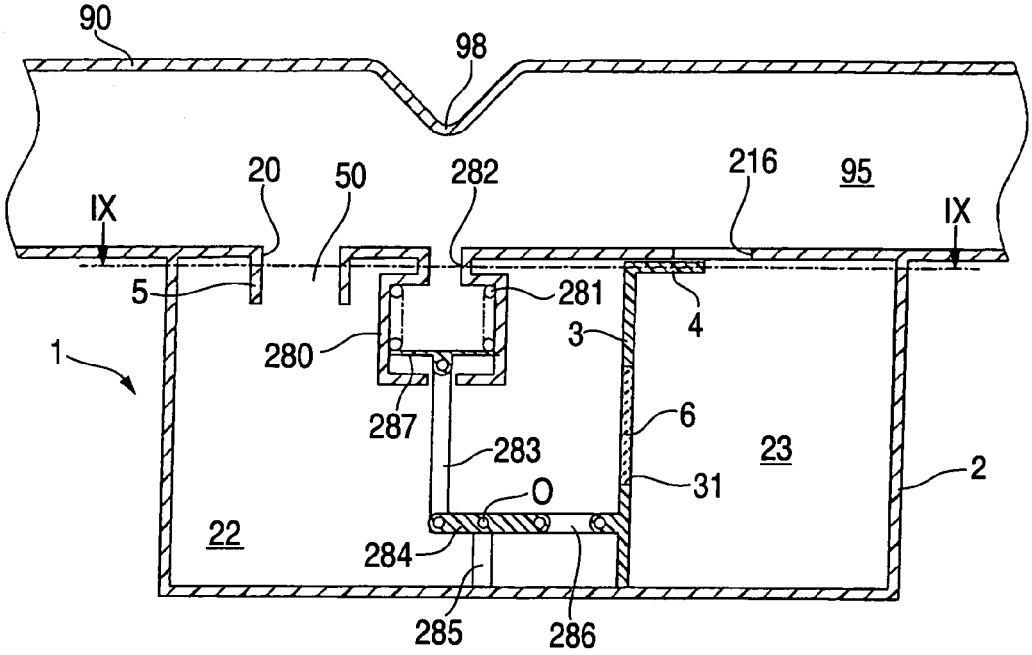
FIG. 10 is a sectional side elevation of the same resonator of the case, in which the engine speed is low.

FIG. 9 is a top plan section (i.e., the section IX—IX of FIG. 10) of the resonator of the embodiment. The portions corresponding to those of FIG. 2 are designated by the common reference numerals. Moreover, FIG. 10 is a side section of the same resonator (i.e., the section X—X of FIG. 9). These Figures show the case, in which the engine speed is low.

As shown in those Figures, the housing 2 is formed into such a hollow cylindrical shape that its two axial end portions are sealed with upper and lower walls. In the upper wall of the housing 2, there are formed the circular first opening 20, a cylindrical communication port 282 and a sector-shaped second opening 216. The upper wall of the intake duct 90 is recessed to form the differential pressure throttling portion 98 to form the communication port 282. The cylindrical portion 5 is protruded downward from the outer circumference side of the first opening 20 in the lower face of the upper wall of the housing 2. In the housing 2, there are arranged a stationary partition 27, the movable partition 3, the movable cover 4, a rotary pin 71, a spring housing portion 280, a coil spring 281, a spring contact plate 287, a first joint arm 283, a rocking arm 284, a rocking arm support member 285 and a second joint arm 286. The rotary pin 71 is arranged on an axis substantially common to the axis of the housing 2. The movable partition 3 is fixed on the rotary pin 71. The movable cover 4 is protruded from the upper edge of the movable partition 3. On the other hand, the stationary partition 27 is fastened on the lower face of the upper wall, the upper face of the lower wall and the inner face of the outer circumference wall of the housing 2. By these movable partition 3 and stationary partition 27, the inside space of the housing 2 is partitioned into the first volume portion 22 and the second volume portion 23.

The spring housing portion 280 is protruded in a cylindrical shape from the lower face of the upper wall of the housing 2. The spring housing portion 280 communicates with the communication port 282. The spring contact plate 287 has a disc shape. The spring contact plate 287 is housed in the spring housing portion 280. The coil spring 281 is sandwiched between the spring contact plate 287 and the upper wall of the spring housing portion 280. The first joint arm 283 has a prism shape. The first joint arm 283 is pivoted at its upper end to the spring contact plate 287. On the other hand, the lower end of the first joint arm 283 is hinged to one end of the prism-shaped rocking arm 284. The rocking arm support member 285 is protruded from the upper face of the lower wall of the housing 2. The rocking arm support member 285 supports the intermediate portion of the rocking arm 284 so that the rocking arm 284 may rock on a rocking pin 0. The second joint arm 286 has a prism shape. This second joint arm 286 is pivoted at its one end to the other end of the rocking arm 284. The other end of the second joint arm 286 is hinged to the movable partition 3.

Figure 11:
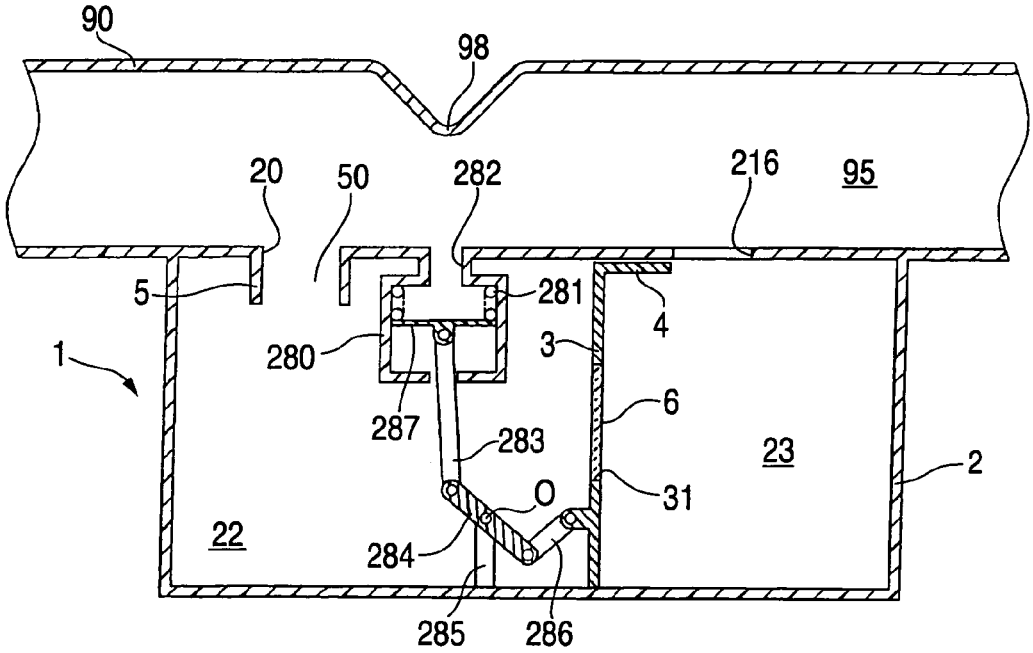
FIG. 11 is a sectional side elevation of the same resonator of the case, in which the engine speed is high.

FIG. 11 shows a side section of the resonator of this embodiment of the case, in which the engine speed is high. In case the engine speed is low, the first volume portion 22 has a relatively large volume, as shown in FIG. 10. On the contrary, the second volume portion 23 has a relatively small volume. Moreover, the second opening 216 has a relatively small opening area.

When the engine speed rises, the intake vacuum rises. This intake vacuum sucks the spring contact plate 287 upward through the communication port 282. When the sucking force of the intake vacuum overcomes the biasing force of the coil spring 281, the spring contact plate 287 moves upward. As a result, the first joint arm 283 also moves upward. The lower end of the first joint arm 283 is pivoted to one end of the rocking arm 284. As a result, the rocking arm 284 rocks clockwise, as shown, on the rocking pin O. When the rocking arm 284 rocks, the other end of the rocking arm 284 moves downward. As a result, one end of the second joint arm 286, as pivoted to the other end of the rocking arm 284, also moves downward. Therefore, the movable partition 3 and the movable cover 4 moves on the rotary pin 71 of FIG. 9 in the direction toward the rocking pin O.

When the movable partition 3 and the movable cover 4 move in the direction toward the rocking pin O, as shown in FIG. 11, the volume of the first volume portion 22 decreases. However, the volume of the second volume portion 23 increases. Moreover, the opening area of the second opening 216 increases.

As the engine speed lowers, the intake vacuum lowers. When the biasing force of the coil spring 281 overcomes the sucking force of the intake vacuum, the spring contact plate 287 moves downward. As a result, the movable partition 3 and the movable cover 4 move in the direction apart from the rocking pin O. As a result, the volume of the first volume portion 22 increases. On the contrary, the volume of the second volume portion 23 decreases. Moreover, the opening area of the second opening 216 decreases.

The resonator 1 of this embodiment has actions and effects similar to those of the resonator of the first embodiment. Moreover, the movable partition 3 and the movable cover 4 of the resonator 1 of this embodiment are rocked by the intake vacuum. This makes it unnecessary to dispose driving parts such as the motor, the sensor and the controller additionally. This makes it possible to reduce the manufacture cost for the resonator 1. Moreover, the structure of the resonator 1 is simplified. Moreover, the resonator 1 of this embodiment is easily mounted especially on the curved portion of the piping.

SIXTH EMBODIMENT

This embodiment is different from the first embodiment in that the movable partition and the movable cover are moved by the intake pressure. Therefore, the description is made exclusively on the difference.

Figure 12:
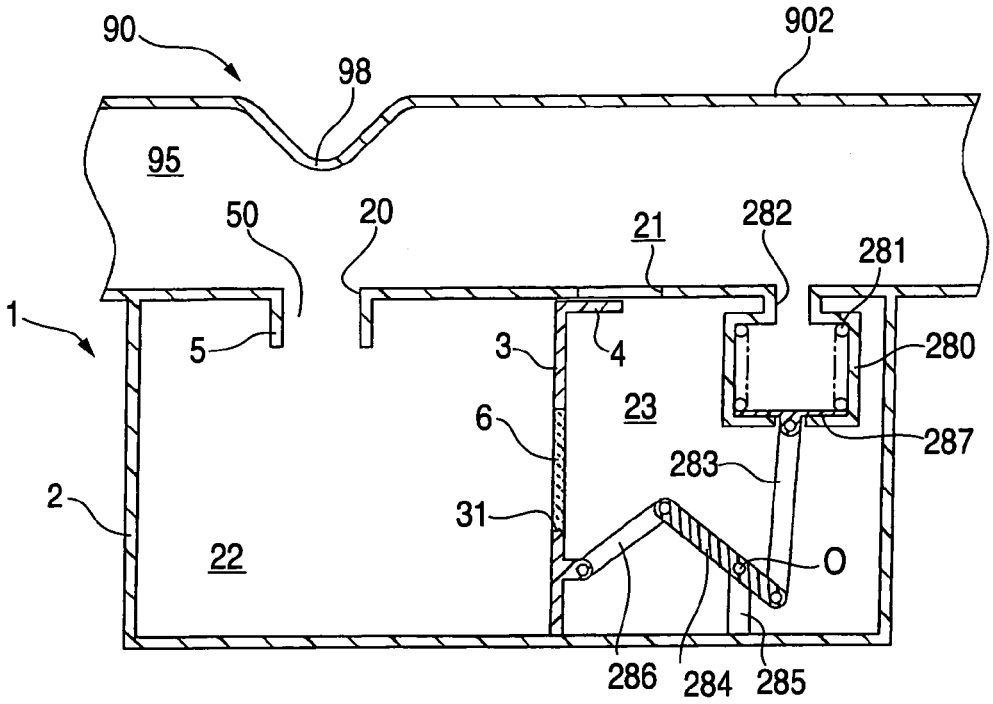
FIG. 12 is a longitudinal section of a resonator of a sixth embodiment of the case, in which the engine speed is low.
Figure 13:
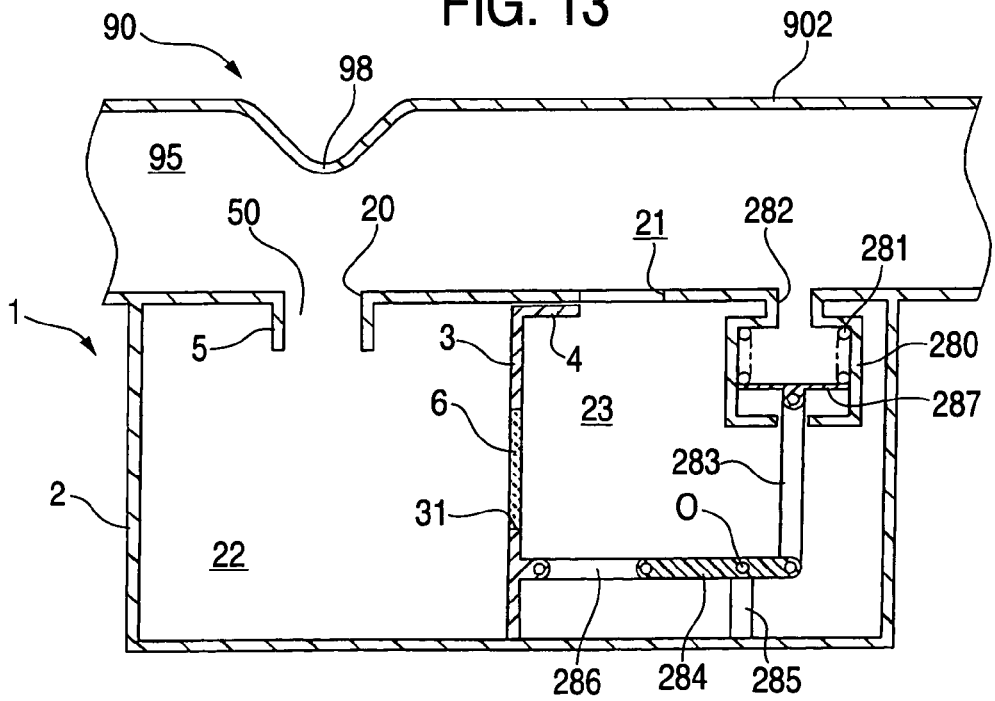
FIG. 13 is a longitudinal section of the same resonator of the case, in which the engine speed is high.

FIG. 12 shows a longitudinal section of the resonator of this embodiment of the case, in which the engine speed is low. FIG. 13 shows a longitudinal section of the same resonator of the case, in which the engine speed is high. In these Figures, the portions corresponding to those of FIG. 3 and FIG. 10 are designated by the common reference numerals.

As shown, the upper wall of the U-shaped bottom portion of the intake duct 90 is recessed to form the differential pressure throttling portion 98. This differential pressure throttling portion 98 reduces the sectional area of the intake passage 95 locally.

The upper wall of the housing 2 is opened to form the first opening 20 to confront the differential pressure throttling portion 98 vertically. Moreover, the cylindrical portion 5 is protruded from the lower face of the upper wall of the housing 2. The inner circumference side of the cylindrical portion defines the communication portion 50. The inside space of the housing 2 is partitioned by the movable partition 3 into the second volume portion 23 on the downstream side and the first volume portion 22 on the upstream side. The slit 21 is opened in the upper wall of the housing 2 on the downstream side of the first opening 20. The slit 21 communicates with the second volume portion 23. In this second volume portion 23, there are arranged the spring housing portion 280, the coil spring 281, the spring contact plate 287, the first joint arm 283, the rocking arm 284, the rocking arm support member 285 and the second joint arm 286.

In case the engine speed is low, as shown in FIG. 12, the first volume portion 22 has a relatively large volume. On the contrary, the second volume portion 23 has a relatively small volume. Moreover, the slit has a relatively small opening area.

When the engine speed rises, the intake vacuum rises. As a result, the movable partition 3 and the movable cover 4 move toward the first volume portion 22. Therefore, the volume of the first volume portion 22 decreases. However, the volume of the second volume portion 23 increases. Moreover, the opening area of the slit 21 increases.

When the movable partition 3 and the movable cover 4 moves, moreover, the second joint arm 286 also moves toward the first volume portion 22. As a result, the rocking arm 284 rocks counter-clockwise, as shown, on the rocking pin O. When the rocking arm 284 rocks, the first joint arm 283 is pushed upward. As a result, the coil spring 281 is compressed by the spring contact plate 287. The movable partition 3 and the movable cover 4 are held at positions, where the sucking force by the suction pressure and the biasing force of the coil spring 281 balance each other.

When the engine speed lowers, the intake vacuum reduces. When the biasing force of the coil spring 281 overcomes the suction force of the intake vacuum, the spring contact plate 287 is pushed down by the coil spring 281. As a result, the movable partition 3 and the movable cover 4 move in the direction toward the rocking pin O. Therefore, the volume of the first volume portion 22 increases. However, the volume of the second volume portion 23 decreases. Moreover, the opening area of the slit 21 decreases.

The resonator 1 of this embodiment has actions and effects similar to those of the resonator of the first embodiment. According to the resonator 1 of this embodiment, the movable partition 3 and the movable cover 4 can be moved by the relatively simple method of providing the differential pressure throttling portion 98. At the same time, it is possible to dispense with the driving parts such as the motor, the speed sensor and the controller for moving the movable partition 3 and the movable cover 4. This makes it possible to reduce the manufacture cost for the resonator 1. Moreover, the structure of the resonator 1 is simplified. According to the resonator 1 of this embodiment, moreover, the coil spring 281 is housed in the second volume portion 23. This makes it possible to prevent the coil spring 281 from being rusted or frozen.

SEVENTH EMBODIMENT

This embodiment is different from the sixth embodiment in that the movable partition and the movable cover are moved by an actuator composed of a solenoid and a plunger. Therefore, the description is made exclusively on the difference.

Figure 14:
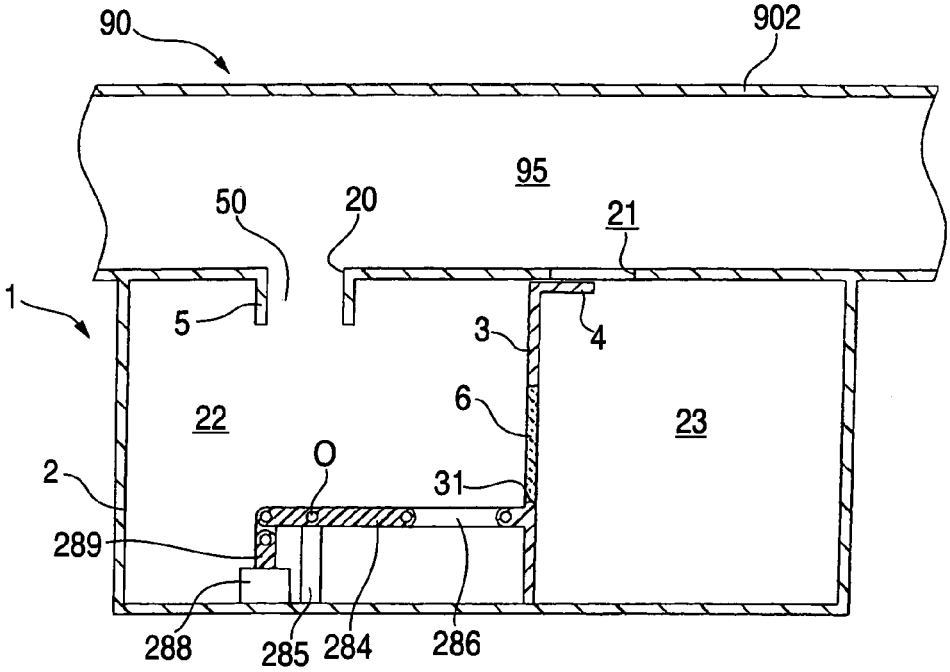
FIG. 14 is a longitudinal section of a resonator of a seventh embodiment of the case, in which the engine speed is low.
Figure 15:
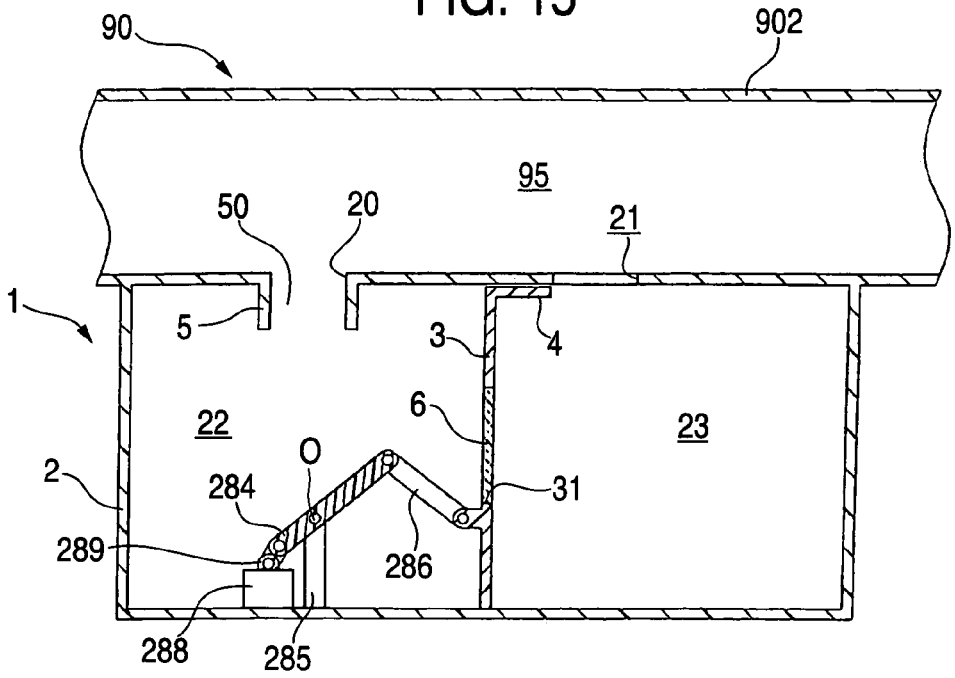
FIG. 15 is a longitudinal section of the same resonator of the case, in which the engine speed is high.

FIG. 14 shows a longitudinal section of the resonator of this embodiment of the case, in which the engine speed is low. FIG. 15 shows a longitudinal section of the same resonator of the case, in which the engine speed is high. In these Figures, the portions corresponding to those of FIG. 12 and FIG. 13 are designated by the common reference numerals. A solenoid 288 is arranged on the upper face of the lower wall of the housing 2. A plunger 289 is inserted into the inner circumference side of the solenoid 288.

In case the engine speed is low, as shown in FIG. 14, the first volume portion 22 has a relatively large volume. On the contrary, the second volume portion 23 has a relatively small volume. Moreover, the slit 21 has a relatively small opening area.

When the engine speed rises, the power supply to the solenoid 288 is interrupted in response to the signal coming from the (not-shown) speed sensor. As a result, the plunger 289 moves downward. Therefore, the rocking arm 284 rocks counter-clockwise, as shown, on the rocking pin O. When the rocking arm 284 rocks, one end of the second joint arm 286 moves upward. As a result, the movable partition 3 and the movable cover 4 move in the direction toward the first volume portion 22. As a result, the volume of the first volume portion 22 decreases. On the contrary, the volume of the second volume portion 23 increases. Moreover, the opening area of the slit 21 increases.

When the engine speed lowers, the power supply to the solenoid 288 is started in response to the signal coming from the speed sensor. As a result, the plunger 289 moves upward. Therefore, the rocking arm 284 rocks clockwise, as shown, on the rocking pin O. When the rocking arm 284 rocks, one end of the second joint arm 286 moves downward. As a result, the movable partition 3 and the movable cover 4 move in the direction toward the second volume portion 23. Therefore, the volume of the first volume portion 22 increases. However, the volume of the second volume portion 23 decreases. Moreover, the opening area of the slit 21 decreases. The resonator 1 of this embodiment has actions and effects similar to those of the resonator of the first embodiment.

EIGHTH EMBODIMENT

Figure 19:
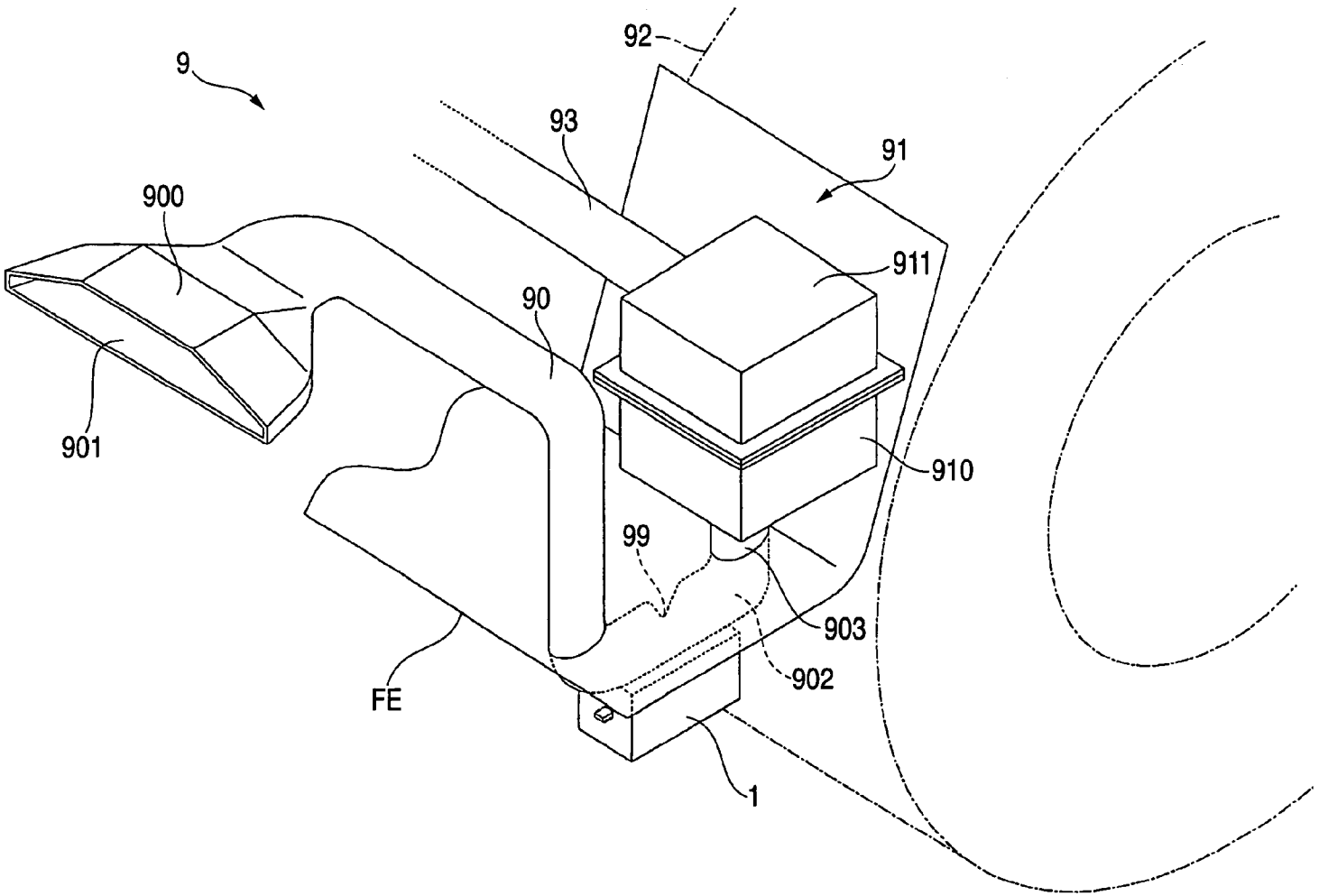
FIG. 19 is a perspective view of an intake system, in which a resonator of an eighth embodiment is arranged.

A first description is made on an intake system, in which a resonator of this embodiment is arranged. FIG. 19 is a perspective view of the intake system, in which the resonator of this embodiment is arranged. As shown in FIG. 19, the intake system 9 is provided with the intake duct 90, the air cleaner 91 and the air cleaner hose 93. An intake passage is defined in the intake system 9. The intake duct 90 and the air cleaner 91 are arranged in a space in front of the front tires 92 (as indicated by single-dotted lines) of a vehicle, The intake duct 90 is made of PP (Polypropylene) into a cylindrical shape. The intake duct 90 is included in an intake member of the invention. The intake duct 90 has its upstream side end portion 900 formed into a flattened trapezoidal shape. An intake port 901 is opened in the upstream side end portion 900. This upstream side end portion 900 is fastened on the (not-shown) radiator upper support. The intake duct 90 is curved into a U-shape. The U-shaped bottom portion 902 of the intake duct 90 is arranged below the fender apron FE. The U-shaped bottom portion 902 is recessed to form the bypass throttling portion 99.

The air cleaner 91 is provided with the dirty side case 910 and the clean side case 911. The dirty side case 910 is made of PP blended with talc into a box shape opened upward. The intake duct 90 is connected at its downstream side end portion 903 to the dirty side case 910. The clean side case 911 is made of PP blended with talc into a box shape opened downward. The clean side case 911 is so arranged over the dirty side case 910 that their openings mate with each other. Between the dirty side case 910 and the clean side case 911, there is sandwiched the (not-shown) air element which is prepared by gusseting nonwoven PET (polyethylene terephthalate) fabric.

The air cleaner hose 93 is made of CR (chloroprene rubber) into the (not-shown) cylindrical bellows. The air cleaner hose 93 is connected at its upstream side end portion to the clean side case 911. On the other hand, the air cleaner hose 93 is connected at its downstream side end portion to the (not-shown) inlet manifold. The resonator 1 is arranged on the U-shaped bottom portion 902 of the intake duct 90. The intake air is introduced from the intake port 901 into the intake duct 90 and is filtered through the air cleaner 91 so that it is fed to the combustion chamber of an engine through the air cleaner hose 93 and an inlet manifold.

Figure 20:
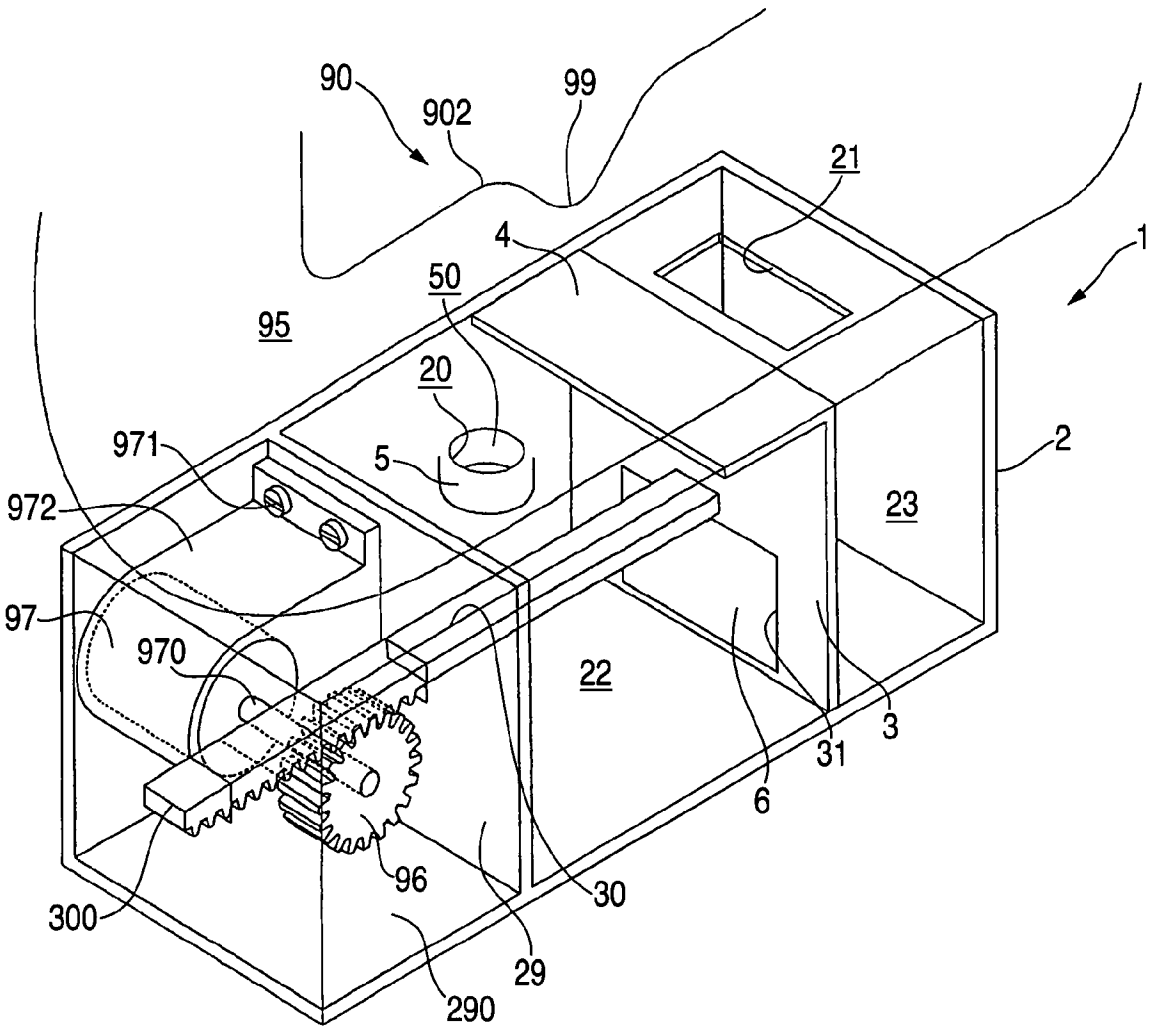
FIG. 20 is a transparent, perspective view of the same resonator.
Figure 21:
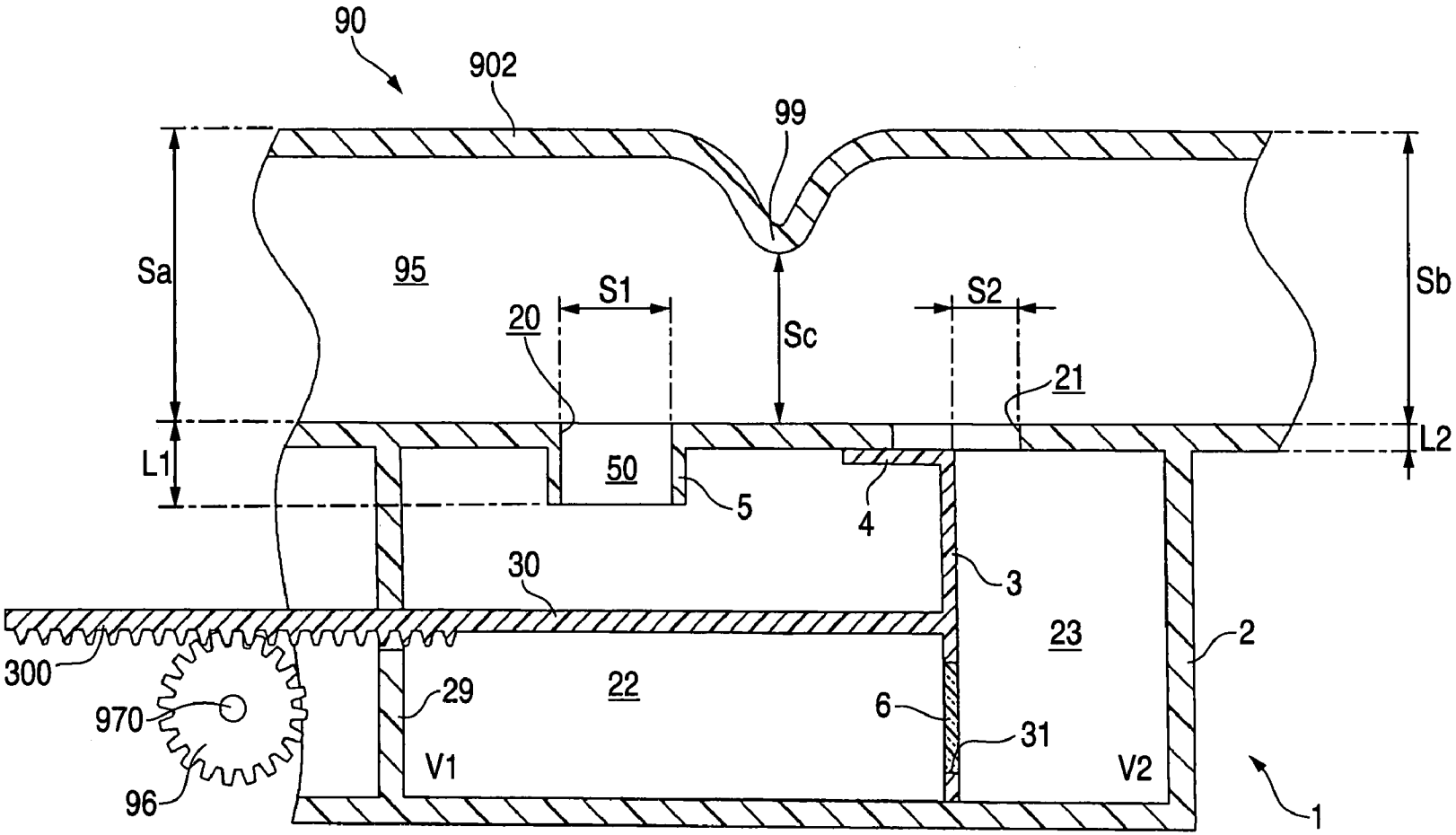
FIG. 21 is a longitudinal section of the same resonator.

Here is described a structure of the resonator of this embodiment. FIG. 20 is a transparent, perspective view of the resonator of this embodiment. FIG. 21 is a longitudinal section of the same resonator. A motor housing chamber, a holder and a screw are omitted from FIG. 21. As shown in FIGS. 20 and 21, the resonator 1 is provided with the housing 2, the movable partition 3, the movable cover 4, the cylindrical portion 5 and an air-permeable member 6.

The housing 2 is made of PP into a box shape. The housing 2 is made integral with the lower wall of the U-shaped bottom portion 902 of the intake duct 90. In the upper wall of the housing 2 (or in the lower wall of the U-shaped bottom portion 902), there is formed the first round opening 20. This first opening 20 communicates with an intake passage 95 in the U-shaped bottom portion 902. The first opening 20 is arranged on the upstream side of the bypass throttling portion 99. In the upper wall of the housing 2 on the downstream side of the bypass throttling portion 99, there is opened the slit 21. This slit 21 is contained in the second opening of the invention. The slit 21 is formed in a wide rectangular shape with respect to the moving direction of the later-described movable partition 3. The slit 21 communicates with the intake passage 95 in the U-shaped bottom portion 902.

The cylindrical portion 5 is made of PP into an axially short cylindrical shape. The cylindrical portion 5 is protruded downward from the lower face of the upper wall of the housing 2. The cylindrical portion 5 is arranged on the outer circumference side of the first opening 20. The cylindrical portion 5 defines the communication portion 50 on its inner circumference side. The communication portion 50 communicates with the first opening 20.

The movable partition 3 is made of PP into a rectangular plate shape. The movable partition 3 is fitted on its outer edge with the (not-shown) seal frame of rubber. In the resonator mode, the movable partition 3 partitions the inside of the housing 2 into the first volume portion 22 and the second volume portion 23. The first volume portion 22 communicates with the communication portion 50. On the other hand, the second volume portion 23 communicates with the slit 21. The movable partition 3 can change the volume of the first volume portion 22 and the volume of the second volume portion 23. From the general center of the surface of the movable partition 3 on the side of the first volume portion 22, there is protruded the rod 30 having a thin plate shape. This rod 30 extends through the motor fixing wall 29 of the housing 2. The rack portion 300, as formed on the through end of the rod 30, meshes in the motor housing chamber 290 with the pinion 96. This pinion 96 is fastened on the spindle 970 of the motor 97. This motor 97 is housed in the holder 972. This holder 972 is fastened on the motor fixing wall 29 by screws 971. The rectangular communication aperture 31 is opened in the movable partition 3 below the root portion of the rod 30.

The air-permeable member 6 is made of nonwoven PET fabric into a rectangular plate shape. The air-permeable member 6 closes the communication aperture 31. Microscopically, therefore, the first volume portion 22 and the second volume portion 23 communicate with each other through the air-permeable member 6.

The movable cover 4 is made of PP into a rectangular plate shape. The movable cover 4 is protruded just like a penthouse from the upper edge of the movable partition 3 toward the second volume portion 23. The movable cover 4 is arranged below the slit 21. As a result, the opening area of the slit 21 can be changed by the movable cover 4.

Figure 22A:
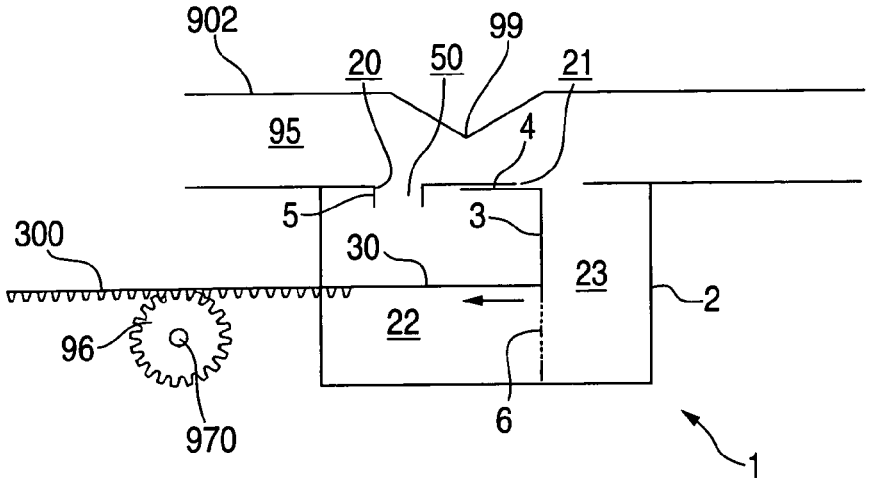
FIG. 22A is a schematic diagram of the same resonator of the case, in which the engine speed is low.
Figure 22B:
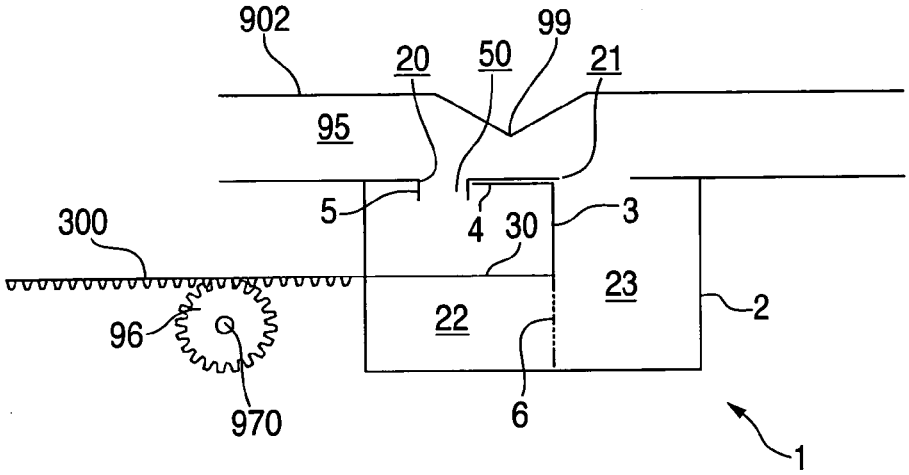
FIG. 22B is a schematic diagram of the same resonator of the case, in which the engine speed is intermediate.
Figure 22C:
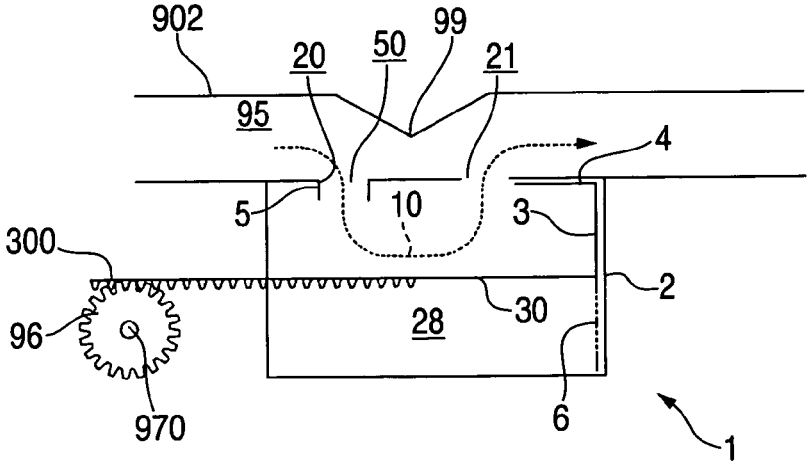
FIG. 22C is a schematic diagram of the same resonator of the case, in which the engine speed is high.

Here is described the switching of the resonator mode and the bypass mode of the resonator of this embodiment. FIGS. 22A to 22C are schematic diagrams of the resonator of this embodiment. FIG. 22A shows the case, in which the engine speed is low (at or lower than 3,000 rpm) ; FIG. 22B shows the case, in which the engine speed is intermediate (higher than 3,000 rpm and at or lower than 4,000 rpm); and FIG. 22C shows the case, in which the engine speed is high (higher than 4,000 rpm.

The resonator mode is selected in case the engine speed is from low to intermediate. In case the engine speed is low, as shown in FIG. 22A, the first volume portion 22 has a relatively larger volume. On the other hand, the second volume portion 23 has a relatively smaller volume. Moreover, the slit 21 has a relatively smaller opening area.

When the engine speed rises, the (not-shown) controller rotates the spindle 970 of the motor 97 (as referred to FIG. 20) in response to a signal coming from the (not-shown) speed sensor. The spindle 970 of the motor 97 is fastened in the pinion 96. As a result, the pinion 96 rotates together with the spindle 970. The pinion 96 meshes with the rack portion 300 of the rod 30. When the pinion 96 rotates, therefore, the rod 30 is pulled by the pinion 96. As a result, the movable partition 3 and the movable cover 4 move toward the first volume portion 22.

As the movable partition 3 and the movable cover 4 move toward the first volume portion 22, as shown in FIG. 22B, the first volume portion 22 becomes small. As shown in FIG. 21, the resonance frequency f1 relating to the first volume portion 22, the communication portion 50 and the first opening 20 can be obtained for the sound velocity C, an opening area S1 of the first opening 20, an axial length L1 of the cylindrical portion 5 and the volume V1 of the first volume portion 22 from the following Formula:

$$f1 = \frac{C}{2\pi}\sqrt{\frac{S1}{V1 \cdot L1}} \quad \text{[Formula 9]}$$

As the engine speed rises, the frequency F1, at which the sound-pressure level is to be lowered in intake noises, rises. As the engine speed rises, on the contrary, the volume V1 of the first volume portion 22 lowers. As a result, the resonance frequency f1 rises.

Likewise, the resonance frequency f2 relating to the second volume portion 23 and the slit 21 can be obtained for the sound velocity C, an opening area 52 of the slit 21, the thickness L2 of the upper wall of the housing 2 and the volume V2 of the second volume portion 23 from the following Formula:

$$f2 = \frac{C}{2\pi}\sqrt{\frac{S2}{V2 \cdot L2}} \quad \text{[Formula 10]}$$

If the sum of the volume of the first volume portion 22 and the volume of the second volume portion 23 is designated by Vt, the relation of Vt=V1+V2 holds.

As the engine speed rises, the frequency F2, at which the sound-pressure level is to be lowered at the intake noises, rises. As the engine speed rises, on the contrary, the volume V1 of the first volume portion 22 lowers so that the volume V2 (=Vt−V1) of the second volume portion 23 inevitably rises. On the other hand, the opening area S2 of the slit 21 increases according to the movement of the movable cover 4. At the same time, the volume V2 and the opening area 32 are so set that the ratio of S2/V2 rises. As a result, the resonance frequency f2 rises. In case the engine speed lowers, the movable partition 3 and the movable cover 4 are moved toward the second volume portion 23.

The bypass mode is selected in case the engine speed is high. In case the engine speed is high, as shown in FIG. 22C, the movable partition 3 and the movable cover 4 are moved over the low-speed case (as referred to FIG. 22A) in the direction toward the second volume portion. As a result, the overlap between the movable cover 4 and the slit 21 disappears. In other words, the slit 21 is opened in its entirety. The bypass portion 28 is formed in the housing 2. The bypass portion 28 has a volume of the sum Vt of the volume V1 of the first volume portion and the volume V2 of the second volume portion in the resonator mode. The bypass portion 28 communicates with the intake passage 95 through the communication portion 50 and the first opening 20. At the same time, the bypass mode 28 communicates with the intake passage 95 through the slit 21. Thus, in the bypass mode, there is formed the bypass intake passage 10 is formed to follow the route of the intake passage 95→the first opening 20→the communication portion 50→the bypass portion 28→the slit 21→the intake passage 95.

Here are described the actions and effects of the resonator of this embodiment. According to the resonator 1 of this embodiment, it is possible in the resonator mode to change not only the volume V1 of the first volume portion 22 and the volume V2 of the second volume portion 23 but also the opening area S2 of the slit 21. As a result, it is easy to bring the two frequencies F1 and F2, for which the sound-pressure levels in the intake noises are to be reduced, and the two resonance frequencies f1 and f2 of the resonator 1 into correspondence with each other.

According to the resonator 1 of this embodiment, moreover, a Helmholtz type resonator is formed in the resonator mode by the portions defining the first opening 20 and the first volume portion 22 in the housing 2 and by the cylindrical portion 5 defining the communication portion 50. The Helmholtz type resonator has a large width for reducing the sound-pressure level. According to the resonator 1 of this embodiment, therefore, the sound-pressure level of a desired frequency can be drastically lowered.

According to the resonator 1 of this embodiment, moreover, the two resonance frequencies f1 and f2 can be shifted in the resonator mode in the same direction as the engine speed changes specifically, in case the engine speed is intermediate (i.e., in case the frequencies F1 and F2 of the intake noises are in the intermediate-frequency range), the resonance frequencies f1 and f2 can be set to a high-frequency range. In case the engine speed is low (i.e., in case the frequencies F1 and F2 of the intake noises are in the low-frequency range), the resonance frequencies f1 and f2 can be set to a low-frequency range.

According to the resonator 1 of this embodiment, moreover, a cavity type resonator portion is formed in the resonator mode by the portion of the housing 2 defining the slit 21 and the second volume portion 23. The cavity type resonator has a wide frequency with for reducing the sound-pressure level. According to the resonator 1 of this embodiment, therefore, it is possible to reduce the sound-pressure level of a wide frequency range including a desired frequency.

According to the resonator 1 of this embodiment, moreover, the air-permeable member 6 is arranged in the communication aperture 31 of the movable partition 3. As a result, it is possible to prevent an anti-resonant portion of a high sound-pressure level from being manifested on the lower side and the higher side of the frequency having the reduced sound-pressure level.

According to the resonator 1 of this embodiment, moreover, the bypass portion 28 to occupy substantially the entirety of the space in the housing is manifested in the bypass mode. The bypass portion 28 functions as the expansion chamber type resonator. In the bypass mode, therefore, the sound-pressure level of the high-frequency region can be lowered.

According to the resonator 1 of this embodiment, moreover, the bypass intake passage 10 is opened in the bypass mode. This makes it possible to retain the dual intake passages 95 and 10 substantially. Therefore, the number of parts for the intake system can be less than that of the case, in which two intake systems are separately and independently arranged in the engine room. Moreover, it is possible to reduce the manufacture cost. Still moreover, the space ratio of the engine room to be occupied by the intake system is reduced.

In the U-shaped bottom portion 902 of the intake duct, according to the resonator 1 of this embodiment, the bypass throttling portion 99 is arranged between the portion, in which the first opening 20 is opened, and the portion, in which the slit 21 is opened. The bypass throttling portion 99 reduces the sectional area of the intake passage 95 locally. According to the resonator 1 of this embodiment, therefore, the intake air is easily introduced in the bypass mode into the first opening 20. In other words, the intake air can be easily shunted to the bypass intake passage 10.

According to the resonator 1 of this embodiment, as shown in FIG. 21, the sectional area Sa of the upstream side passage of the U-shaped bottom portion 902, the sectional area Se of the downstream side passage, the sectional area Sc of the passage of the bypass throttling portion 99, the opening area S1 of the first opening 20 and the opening area 32 of the slit 21 are set to satisfy the relations of $Sa \leqq S1+Sc$ and $Sa \leqq S2+Sb$, These relations reduce the ventilation resistance.

NINTH EMBODIMENT

This embodiment is different from the eighth embodiment in that a third opening is opened in the upper wall of the housing. Therefore, the description is made exclusively on the difference.

Figure 23A:
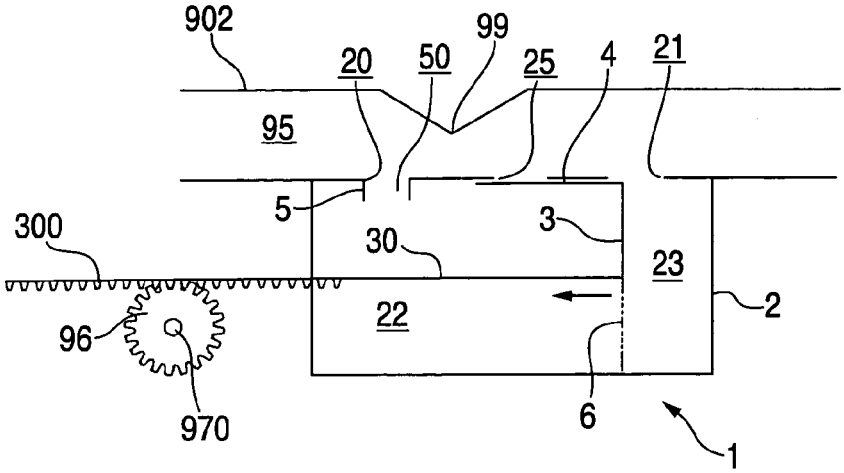
FIG. 23A is a schematic diagram of a resonator of a ninth embodiment of the case, in which the engine speed is low.
Figure 23B:
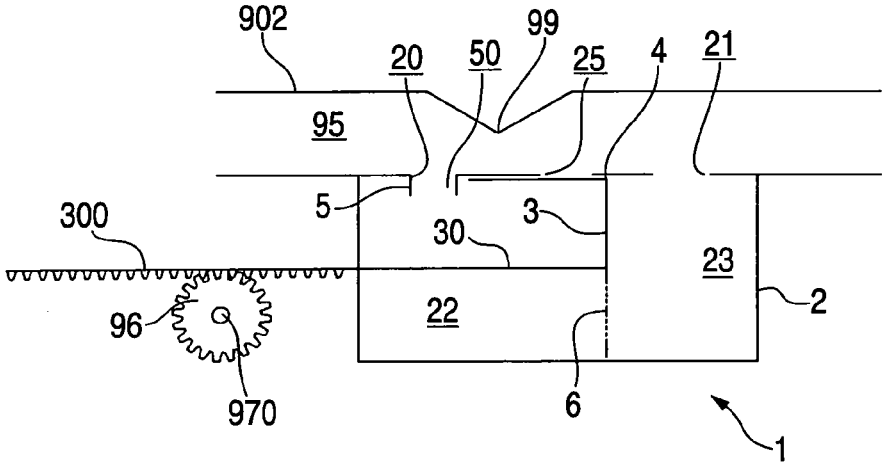
FIG. 23B is a schematic diagram of the same resonator of the case, in which the engine speed is intermediate.
Figure 23C:
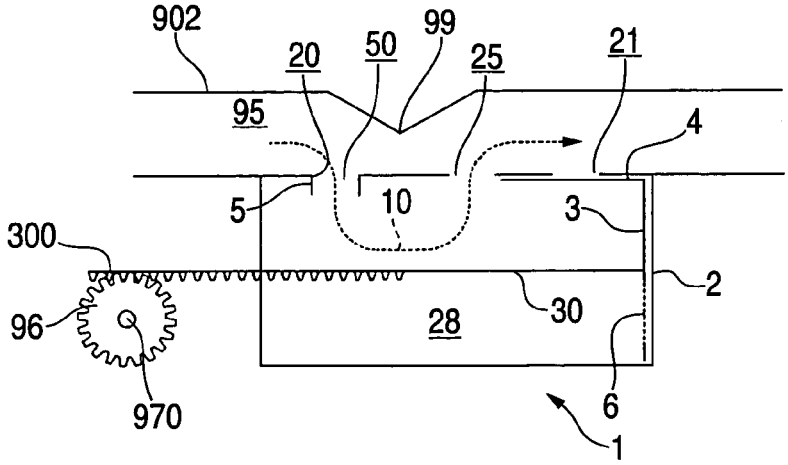
FIG. 23C is a schematic diagram of the same resonator of the case, in which the engine speed is high.

FIGS. 23A to 23C are schematic diagrams of the resonator of this embodiment. FIG. 23A shows the case, in which the engine speed is low (at or lower than 3,000 rpm); FIG. 23B shows the case, in which the engine speed is intermediate (higher than 3,000 rpm and at or lower than 4,000 rpm); and FIG. 23C shows the case, in which the engine speed is high (higher than 4,000 rpm. Here, the portions corresponding to those of FIGS. 22A to 22C are designated by the common reference numerals.

In the upper wall of the housing 2, as shown, the first opening 20, the third opening 25 and the slit 21 are opened in series along the flow direction of the intake air. The third opening 25 has a circular shape. The bypass throttling portion 99 is arranged between the first opening 20 and the third opening 25.

The resonator mode is selected in case the engine speed is from low to intermediate. In case the engine speed is low, as shown in FIG. 23A, the first volume portion 22 has a relatively large volume. On the other hand, the second volume portion 23 has a relatively small volume. Moreover, the slit 21 has a relatively small opening area. On the other hand, the third opening 25 is closed with the movable cover 4.

As the engine speed rises, the controller causes the spindle 970 of the motor 97 to rotate in response to the signal coming from the speed sensor. As a result, the pinion 96 also rotates. As the pinion 96 rotates, the rod 30 is pulled by the pinion 96. Therefore, the movable partition 3 and the movable cover 4 move toward the first volume portion 22.

As the movable partition 3 and the movable cover 4 move toward the first volume portion 22, as shown in FIG. 23B, the volume of the first volume portion 22 decreases. On the other hand, the volume of the second volume portion 23 increases. Moreover, the opening area of the slit 21 increases. In case the engine speed lowers, the movable partition 3 and the movable cover 4 are moved toward the second volume portion 23.

The bypass mode is selected in case the engine speed is high. In case the engine speed is high, the movable partition 3 is moved largely to the second volume portion, as shown in FIG. 23C. Then, the slit 21 is closed in its entirety with the movable cover 4. On the contrary, the third opening 25, which has been closed in the resonator mode, is opened by the movement of the movable cover 4. Then, there is formed the bypass intake passage 10, which connects the intake passage 95→the first opening 20→the communication portion 50→the bypass portion 28→the third opening 25→the intake passage 95. The resonator 1 of this embodiment has actions and effects similar to those of the resonator of the first embodiment.

TENTH EMBODIMENT

This embodiment is different from the first embodiment in that a group of multiple pores is formed in place of the slit in the upper wall of the housing. Therefore, the following description is made exclusively on the difference.

Figure 24:
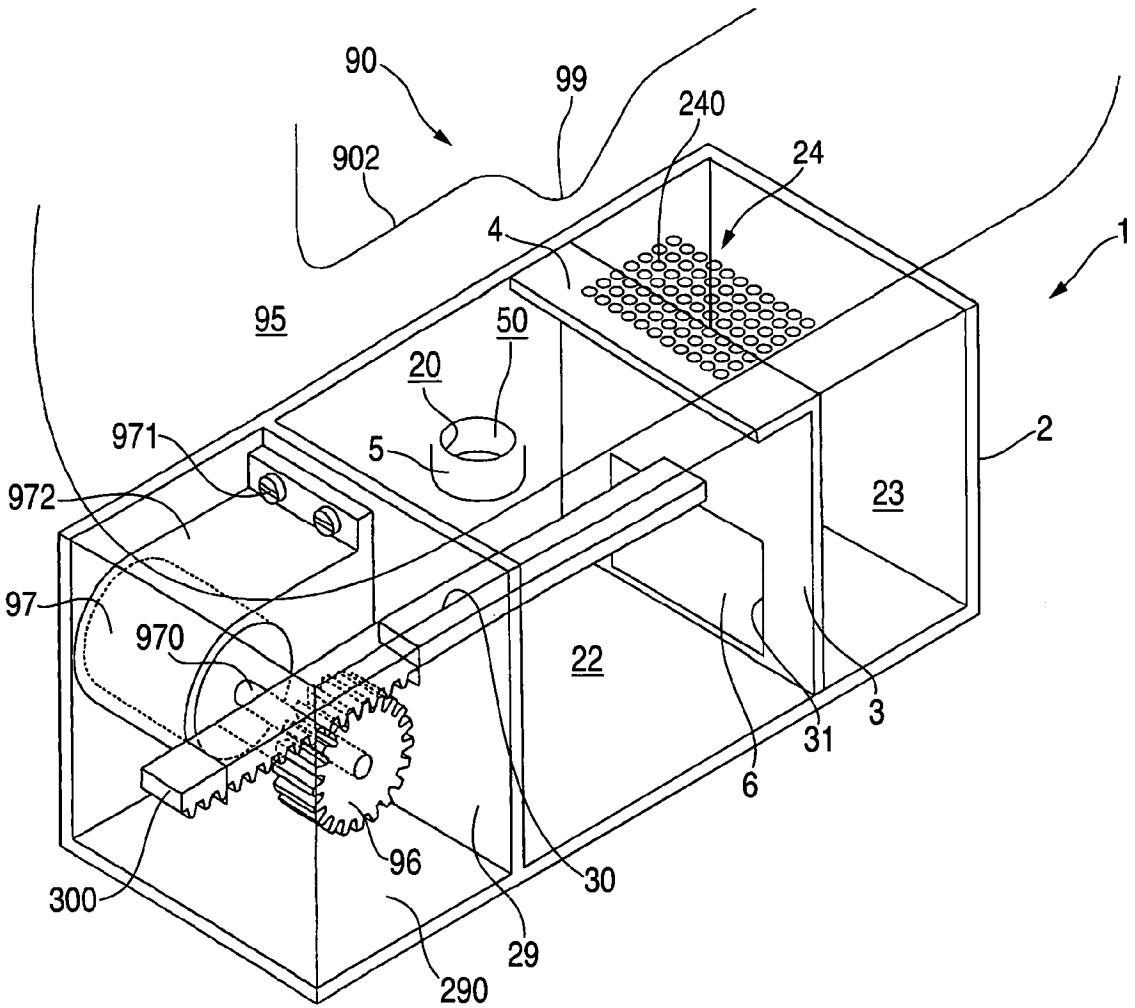
FIG. 24 is a transparent, perspective view of a resonator of a tenth embodiment.

FIG. 24 is a transparent, perspective view of a resonator of this embodiment. Here, the portions corresponding to those of FIG. 20 are designated by the common reference numerals. The small pores 240 are formed in the upper wall of the housing 2. The multiple pores 240 make up the pore group 24. This pore group 24 is arranged widely in the direction perpendicular to the moving direction of the movable partition 3.

In the resonator mode, the pore group 24 provides the communication between the intake passage 95 and the second volume portion 23. In the bypass mode, on the other hand, there is formed a bypass intake passage, which connects the intake passage 95→the first opening 20→the communication portion 50→the bypass portion→the pore group 24→the intake passage 95. The resonator 1 of this embodiment has actions and effects similar to those of the resonator of the first embodiment.

ELEVENTH EMBODIMENT

This embodiment is different from the eighth embodiment in that a single volume portion is formed in the resonator mode. Therefore, the following description is made exclusively on the difference.

Figure 25:
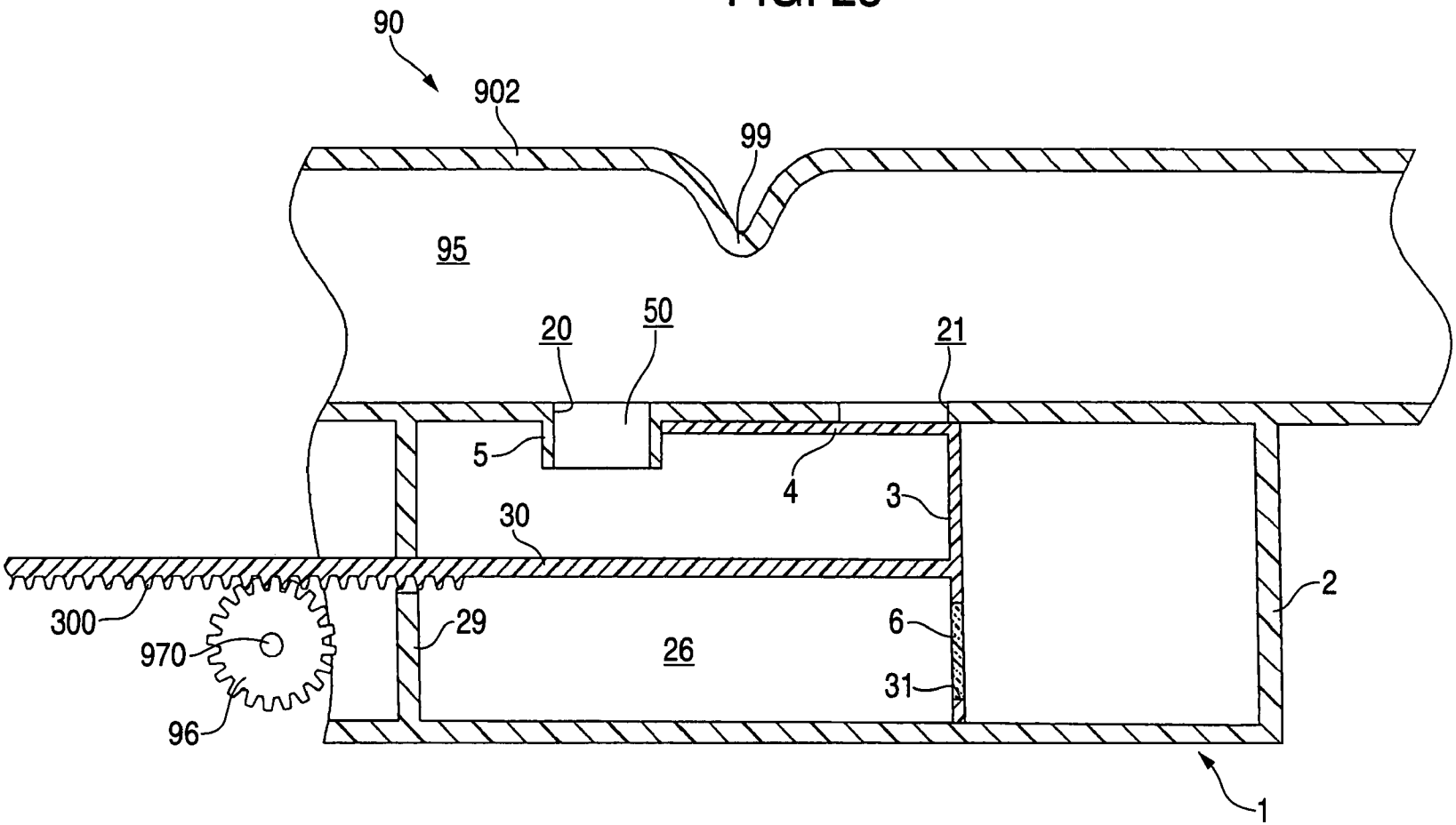
FIG. 25 is a longitudinal section of a resonator of an eleventh embodiment in a resonator mode.
Figure 26:
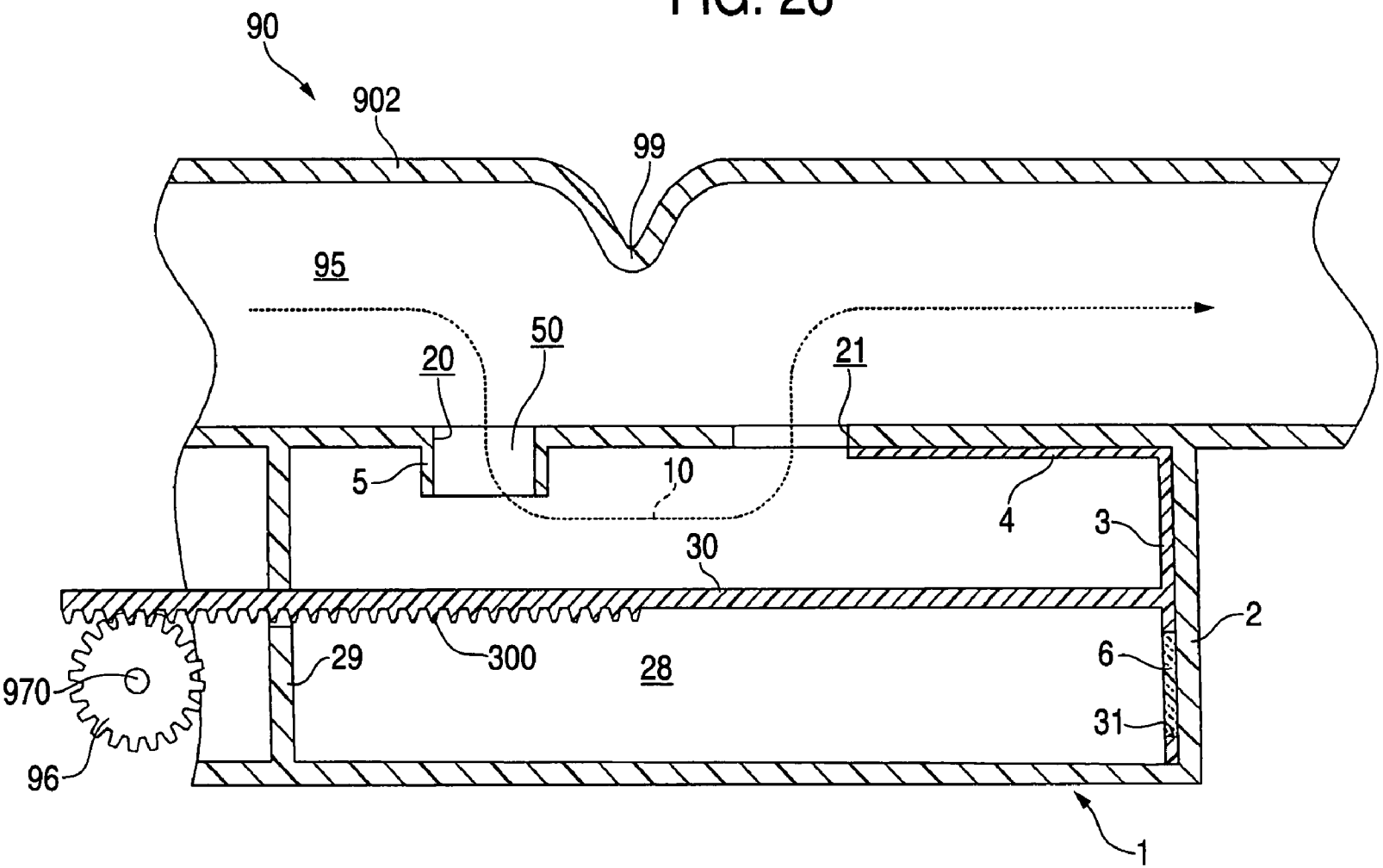
FIG. 26 is a longitudinal section of the same resonator in a bypass mode.

FIG. 25 is a longitudinal section of the resonator of this embodiment in the resonator mode. FIG. 26 is a longitudinal section of the same resonator in the bypass mode. Here, the portions corresponding to those of FIG. 21 are designated by the common reference numerals.

The resonator mode is selected in case the engine speed is from low to intermediate. In the resonator mode, as shown in FIG. 25, the slit 21 is completely closed with the movable cover 4. As a result, the inside of the housing 2 is defined to form a single volume portion 26 leading to the communication portion 50.

The bypass mode is selected in case the engine speed is high. In the bypass mode, as shown in FIG. 26, the bypass intake passage is formed to connect the intake passage 95→the first opening 20→the communication portion 50→the bypass portion 28→the slit 21→the intake passage 95. The resonator 1 of the embodiment has actions and effects similar to those of the resonator of the first embodiment.

The invention has been described in connection with its embodiments. However, the invention should not be limited to those embodiments. The invention could be embodied in the various modified and improved modes which can be conceived by those skilled in the art.

In the foregoing first to seventh embodiments, for example, there have been arranged the Helmholtz type resonator portion relating to the first volume portion 22, the communication portion 50 and the first opening 20, and the cavity type resonator portion relating to the second volume portion 23 and the second openings 21 and 26. However, no especial restriction is made on the type of the resonator portion. For example, a pair of Helmholtz type resonator portions and a pair of cavity type resonator portions may be arranged. Then, it is sufficient that the opening of one resonator portion has a variable opening area.

In the foregoing eighth to tenth embodiments, for example, in the resonator mode time, there have been arranged the Helmholtz type resonator portion relating to the first volume portion 22, the communication portion 50 and the first opening 20, and the cavity type resonator portion relating to the second volume portion 23 and the slit 21. However, no especial restriction is made on the type of the resonator portion. For example, a pair of Helmholtz type resonator portions and a pair of cavity type resonator portions may be arranged.

In the foregoing embodiments, on the other hand, the air-permeable member 6 is made of nonwoven PET fabric. However, no especial restriction is made on the material of the air-permeable member 6. This air-permeable member 6 may also be made of nonwoven PP fabric or nonwoven PA (polyamide) fabric. The air-permeable member 6 may be made of not only the nonwoven fabric but also PET fabric, PP fabric, PA fabric or cotton fabric. The air-permeable member 6 may also be made of sponge of continuously foamed urethane or sponge of continuously foamed EPDM (ethylene propylene diene monomer). Filter paper may also be used.

In the foregoing embodiments, on the other hand, the intake duct 90 is made of PP. However, the intake duct 90 may also be made of PE (polyethylene) or the like.

Moreover, no especial restriction is made on the method of jointing the air-permeable member 6 to the communication aperture 31 of the movable partition 3. The air-permeable member 6 may also be jointed by a welding method such as the heat-plate welding, the vibration welding or the ultrasonic welding method. The air-permeable member 6 may also be jointed with an adhesive. Moreover, no especial restriction is made on the arranging place, number and shape of the air-permeable member 6.

In the foregoing embodiments, on the other hand, the housing 2 and the intake duct 90 are made integral but may be made separate. In the embodiments, moreover, the resonator 1 is arranged below the fender apron FE, but its arranging position is not especially restricted. Moreover, the resonator 1 may be arranged not only at the intake duct 90 but also at another intake member such as the air cleaner 91 or the air cleaner hose 93.

In the foregoing embodiments, on the other hand, the movable partition 3 is moved by the motor 97 but may be moved by the intake vacuum. In this modification, it is sufficient to dispose such a pipe newly as to connect the air cleaner hose 93 and the housing 2, and to define such a vacuum feed passage in that pipe as to connect the intake passage in the air cleaner hose 93 and the first volume portion 22 or the second volume portion 23. Alternatively, a surge tank for stabilizing the feed vacuum may be disposed midway of the pipe.

In the foregoing embodiments, on the other hand: the low speed is set to 3,000 rpm or less; the intermediate speed is set over 3,000 rpm to 4,000 rpm or less; and the high speed is set over 4,000 rpm. However, these set values may also be suitably changed according to the frequency of the intake noises or the amount of the intake air demanded by the combustion chamber.

Figure 27:
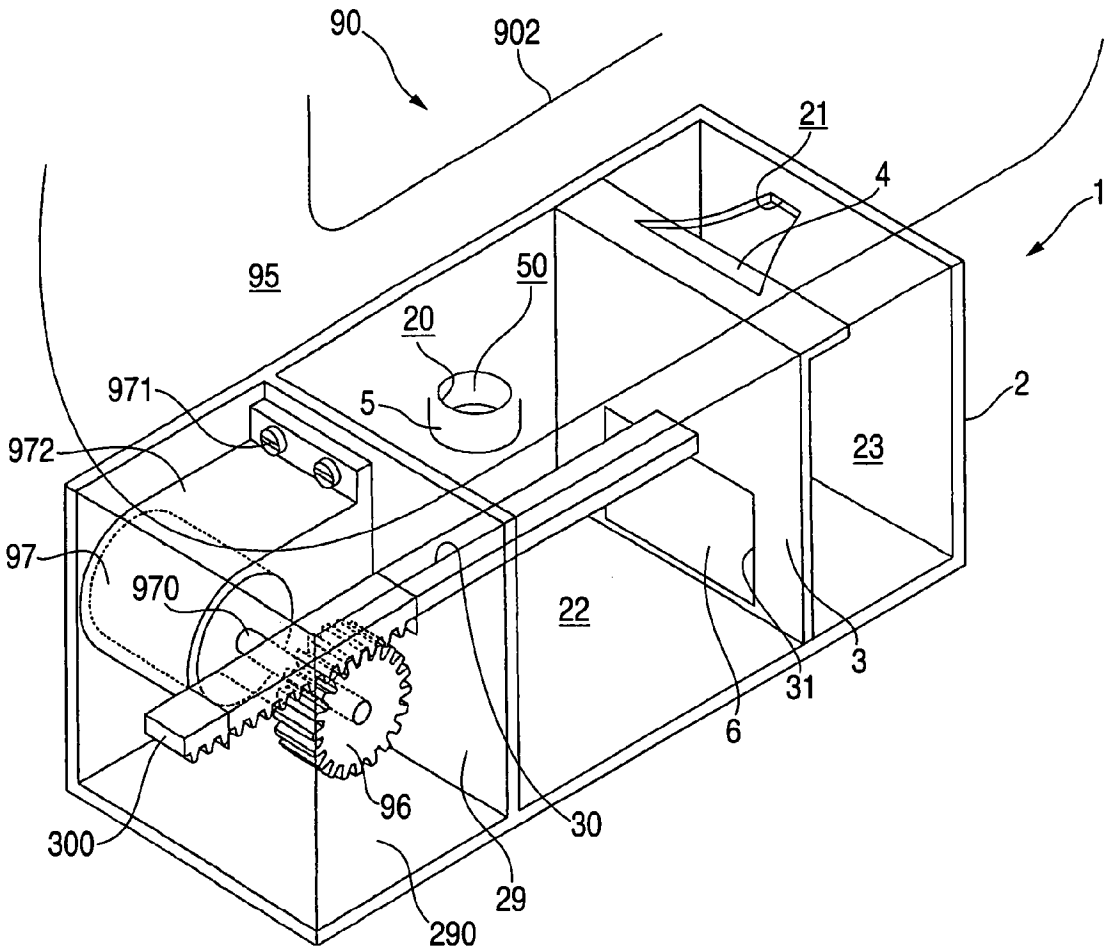
FIG. 27 is a transparent, perspective view of the same resonator.

In the foregoing embodiments, on the other hand, the slit 21 is formed in the rectangular shape. However, no especial restriction is made on the shape of the slit 21. For example, the slit 21 may have an arbitrary shape, as shown in FIG. 27.

EXAMPLE

Experiments, which were done using the intake system 9 having the resonator 1 of the first embodiment, are described in the following with reference to FIG. 1 to FIG. 3. The intake system 9 of the first embodiment is employed as Example. On the other hand, an intake system having no resonator is employed as Comparison.

Figure 16A:
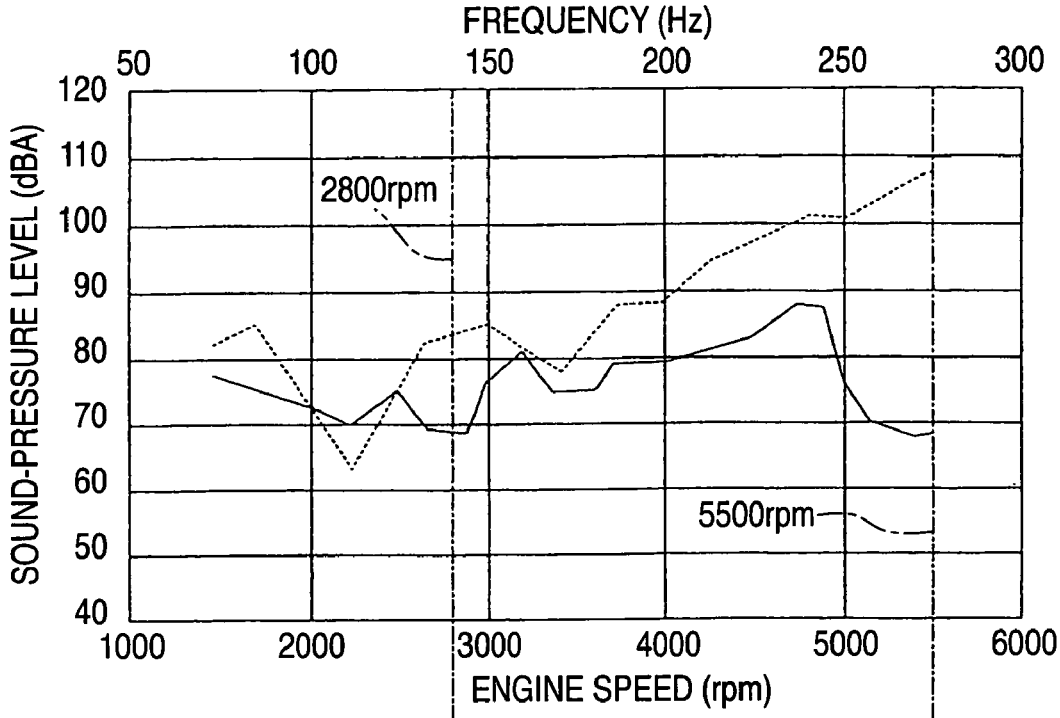
FIG. 16A is a graph plotting primary explosion components of the intake noises of a four-cylinder engine in the intake system having the resonator of the first embodiment.
Figure 16B:
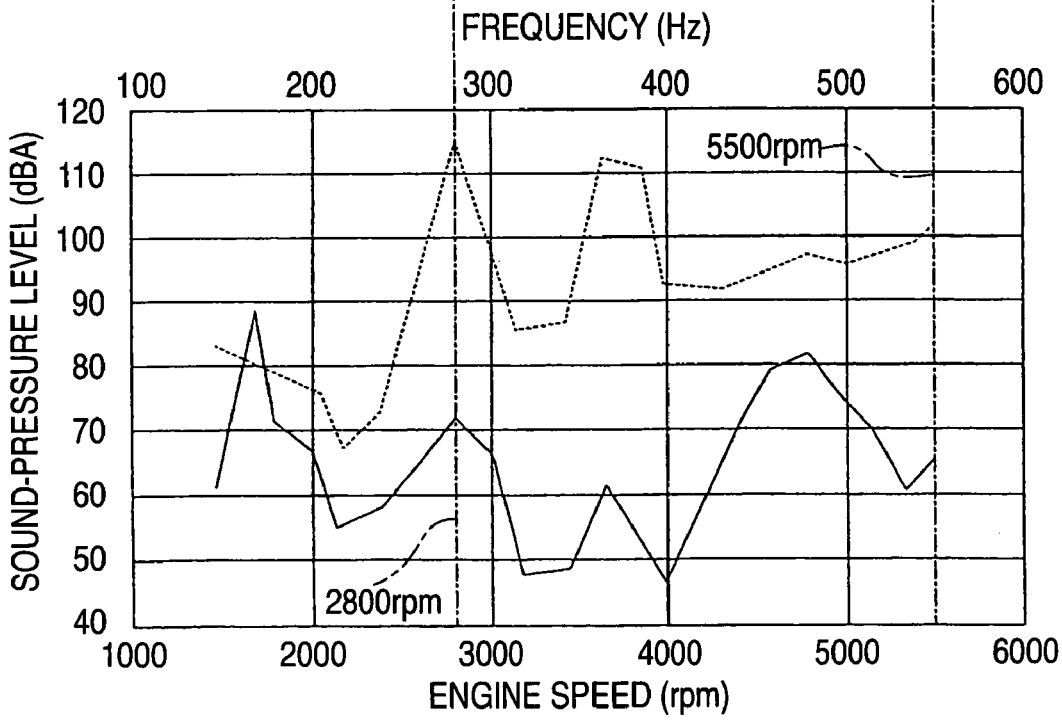
FIG. 16B is a graph plotting secondary explosion components of the intake noises of the four-cylinder engine in the same intake system.
Figure 17A:
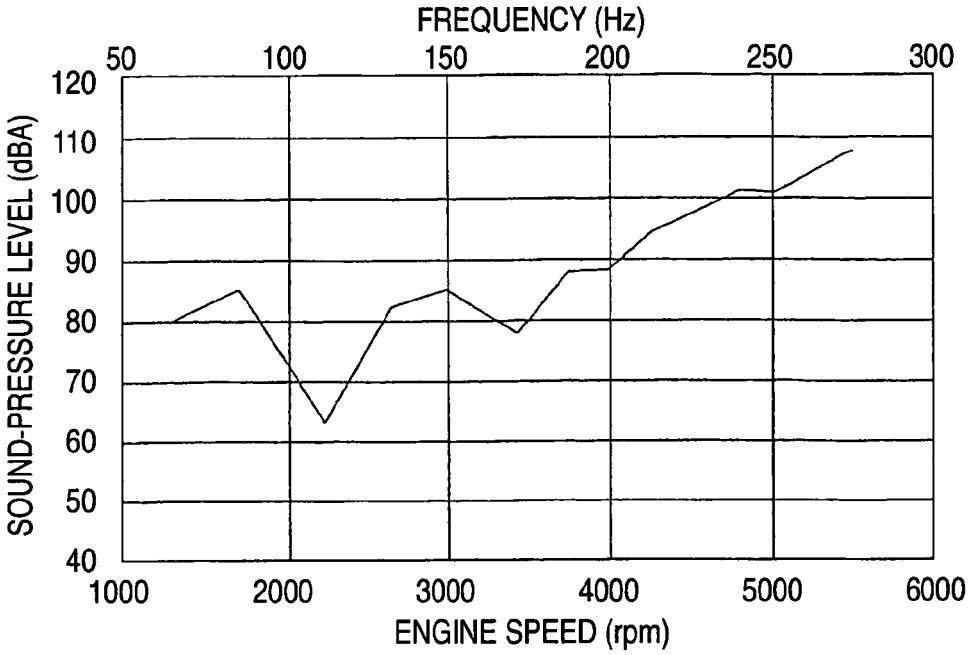
FIG. 17A is a graph plotting primary explosion components of the intake noises of the four-cylinder engine in the intake system having no resonator.
Figure 17B:
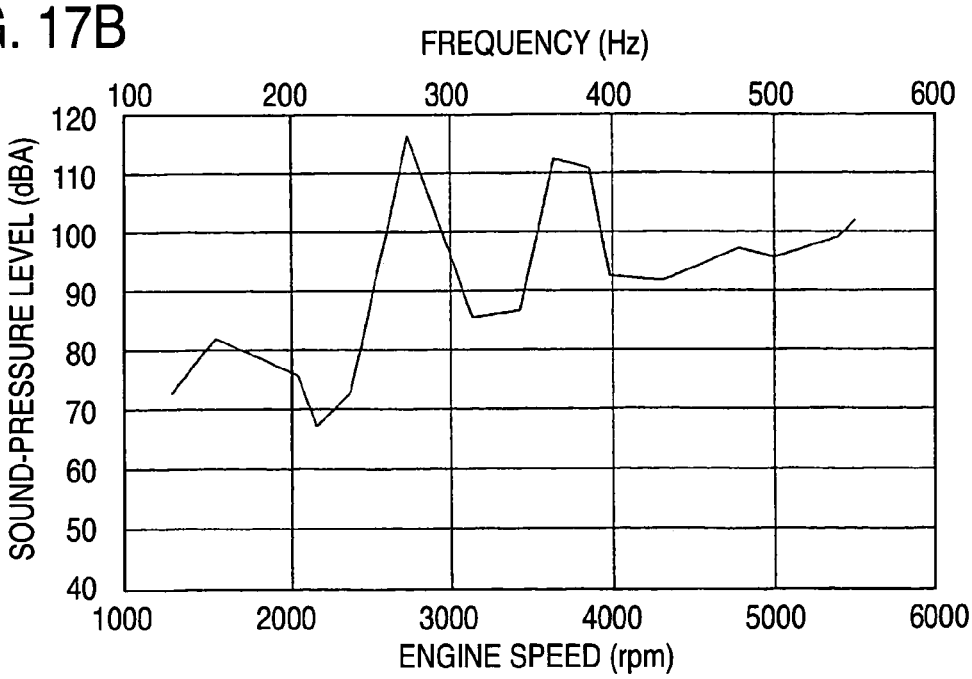
FIG. 17B is a graph plotting secondary explosion components of the intake noises of the four-cylinder engine in the same intake system.
Figure 18:
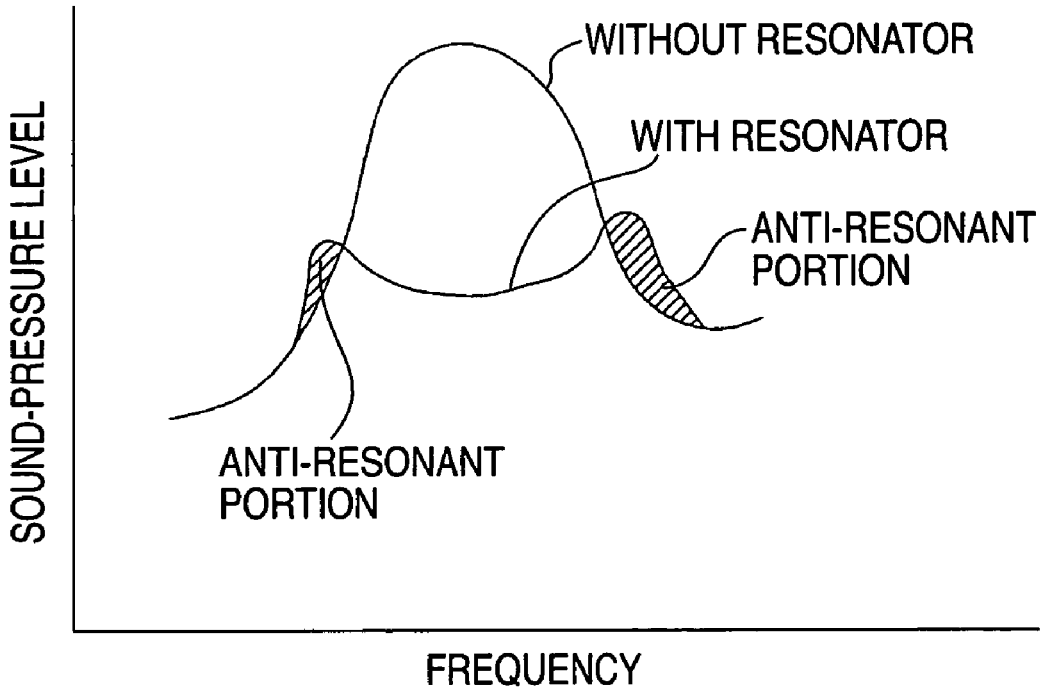
FIG. 18 is a schematic diagram illustrating the reducing behavior of a sound-pressure level.

FIG. 16A plots primary explosion components of the intake noises of a four-cylinder engine, and FIG. 16B plots secondary explosion components of the intake noises of the same engine. In these Figures, the abscissa indicates the engine speed (rpm), and the ordinate indicates the sound-pressure level (dBA). In the Figures, solid curves indicate the data of Example, and dotted curves indicate the data of Comparison. Here, the data of Comparison are identical to those of FIG. 17. Moreover, white noises are generated from a speaker arranged on the downstream side of the intake manifold so that the sound sampled from a microphone arranged on the upstream side of the intake port 901 is employed as the intake noises.

The first opening 20 has the opening area S1 of 7.1 $cm^2$. The first volume portion 22 has the volume V1 of 3,000 cc. The cylindrical portion 5 has the axial length L1 of 100 mm. The slit 21 has the opening area S2 of 20 $cm^2$. The second volume portion 23 has the volume V2 of 2,000 cc. The upper wall of the housing 2 has the thickness L2 of 2.5 mm. The air-permeable member 6 has a thickness of 2.5 mm.

It is round from Figures that the intake noises of both the primary explosion components and the secondary explosion components are reduced substantially all over the engine speed (frequency) range. In case the engine speed is so low as 2,800 rpm, it is found that the sound-pressure level of the primary explosion components (at 140 Hz) are reduced by about 15 dBA from about 84 dBA to about 69 dBA. This reduction is understood to come from the sound-pressure level reducing effect by the Helmholtz type resonator portion relating the first volume portion 22, the communication portion 50 and the first opening 20.

In the case of the same engine speed, moreover, it is found that the sound-pressure level of the secondary explosion components (of 280 Hz) is reduced by about 44 dBA from about 115 dBA to about 72 dBA. This reduction is understood to come from the sound-pressure level reducing effect by the cavity type resonator portion relating to the second volume portion 23 and the slit 21.

In case the engine speed is so high as 5,500 rpm, on the other hand, it is found that the sound-pressure level of the primary explosion components (at 275 Hz) are reduced by about 39 dBA from about 108 dBA to about 69 dBA. This reduction is understood to come from the sound-pressure level reducing effect by the Helmholtz type resonator portion relating the first volume portion 22, the communication portion 50 and the first opening 20.

In the case of the same engine speed, moreover, it is found that the sound-pressure level of the secondary explosion components (of 550 Hz) is reduced by about 36 dBA from about 101 dBA to about 65 dBA. This reduction is understood to come from the sound-pressure level reducing effect by the cavity type resonator portion relating to the second volume portion 23 and the slit 21.

Thus, according to the resonator 1 of the first embodiment, in case the engine speed is low, it is found that the Helmholtz type resonator portion relating to the first volume portion 22, the communication portion 50 and the first opening 20 functions as the resonator for the low-frequency range (less than 150 Hz). It is also found that the cavity type resonator portion relating to the second volume portion 23 and the slit 21 functions as the resonator for the intermediate-frequency range (at or more than 150 Hz and less than 300 Hz).

In case the engine speed is high, on the other hand, it is found that the Helmholtz type resonator portion relating to the first volume portion 22, the communication portion 50 and the first opening 20 functions as the resonator for the intermediate-frequency range (at or more than 150 Hz and less than 300 Hz). It is also found that the cavity type resonator portion relating to the second volume portion 23 and the slit 21 functions as the resonator for the high-frequency range (more than 300 Hz).

What is claimed is:

1. A resonator comprising:

a housing arranged in an intake member for defining an opening to communicate with an intake passage and a volume portion to communicate with the opening;

a movable partition which can change the volume of the volume portion; and a movable cover, which protrudes from the movable partition for changing the opening area of the opening.

2. The resonator according to claim 1, wherein the housing is arranged in an intake member defining an intake passage, for defining a first opening and a second opening to communicate with the intake passage, a first volume portion to communicate with the first opening, and a second volume portion to communicate with the second opening;

the movable partition is made movable for partitioning the first volume portion and the second volume portion to change the volume of the first volume portion and the volume of the second volume portion; and the movable cover is associated with the movable partition for changing the opening area of the second opening.

3. The resonator according to claim 2, further comprising a cylindrical member for defining a communicating portion to provide the communication between the first opening and the first volume portion.

4. The resonator according to claim 2, wherein the movable partition and the movable cover move, for the volume V1 of the first volume portion, the volume V2 of the second volume portion and the opening area S2 of the second opening, such that V1 decreases and such that S2/V2 increases in case the engine speed rises.

5. The resonator according to claim 2, wherein the movable partition and the movable cover are moved by a vacuum created by the intake air flowing through the intake passage.

6. The resonator according to claim 5, further comprising a differential pressure throttling portion disposed in the intake member, at a location where the first opening is opened, for throttling the sectional area of the intake passage to establish a differential pressure between the first volume portion and the second volume portion thereby to drive the movable partition and the movable cover.

7. The resonator according to claim 2, wherein the second opening has a slit shape.

8. The resonator according to claim 2, wherein the second opening is formed of a pore group having a multiplicity of pores.

9. The resonator according to claim 2, wherein the movable partition further comprises:

a communication aperture for providing the communication between the first volume portion and the second volume portion; and an air-permeable member for closing the communication aperture.

10. The resonator according to claim 2, wherein the housing further defines a third opening for communicating with the intake passage and the first volume portion;

the movable cover closes the third opening and changes the opening area of the second opening, in case the engine speed is from low to intermediate; and the movable cover closes the second opening, and a bypass intake passage for providing the communication among the first opening, the first volume portion and the third opening is opened, in case the engine speed is high.

11. The resonator according to claim 10, further comprising a bypass throttling portion arranged in the intake member between the first opening and the third opening for throttling the sectional area of the intake passage thereby to guide the intake air to the first opening and the third opening, which are relatively upstream openings.

12. The resonator according to claim 1, wherein the housing is arranged in an intake member defining an intake passage, for defining a plurality of openings to communicate with the intake passage, and a silencer chamber to communicate with the plural openings; and the movable partition for switching a resonator mode, in which at least one volume portion to communicate with one of the openings is formed in the silencer chamber, and a bypass mode, in which a bypass portion to communicate with at least two of the openings is formed in the silencer chamber.

13. The resonator according to claim 12, wherein in the resonator mode, the movable partition divides the silencer chamber into the volume portions.

14. The resonator according to claim 12, wherein the movable cover is associated, in the resonator mode, with the movable partition for changing the opening area of at least one of the plural openings.

15. The resonator according to claim 13, wherein the movable cover is associated, in the resonator mode, with the movable partition for changing the opening area of the second opening; and the movable partition and the movable cover move, for the volume V1 of the first volume portion, the volume V2 of the second volume portion and the opening area S2 of the second opening, such that V1 decreases and such that S2/V2 increases in case the engine speed rises.

16. The resonator according to claim 12, further comprising a cylindrical member for defining a communicating portion between at least one of the plural openings and the silencer chamber.

17. The resonator according to claim 12, wherein at least one of the plural openings has a slit shape.

18. The resonator according to claim 12, wherein at least one of the plural openings is formed of a pore group having a multiplicity of pores.

19. The resonator according to claim 12, wherein the movable partition further comprises:

a communication aperture for providing through the moveable partition; and an air-permeable member for closing the communication aperture.

20. The resonator according to claim 12, further comprising a bypass throttling portion arranged in the intake member between an arbitrary two of the plural openings, for throttling the sectional area of the intake passage thereby to guide the intake air to relatively upstream ones of the openings.

21. The resonator according to claim 1, wherein the movable cover protrudes from an upper edge of the movable portion.

* * * * *